US010875273B2

(12) United States Patent
Tachi et al.

(10) Patent No.: US 10,875,273 B2
(45) Date of Patent: Dec. 29, 2020

(54) FOLDABLE STRUCTURE, METHOD OF MANUFACTURING FOLDABLE STRUCTURE, MANUFACTURING DEVICE OF FOLDABLE STRUCTURE, AND NON-TRANSITORY COMPUTER-READABLE COMPUTER MEDIUM STORING A PROGRAM

(71) Applicants: JAPAN SCIENCE AND TECHNOLOGY AGENCY, Saitama (JP); THE BOARD OF TRUSTEES OF THE UNIVERSITY OF ILLINOIS, Urbana, IL (US)

(72) Inventors: Tomohiro Tachi, Tokyo (JP); Yasushi Yamaguchi, Tokyo (JP); Evgueni T. Filipov, Urbana, IL (US); Glaucio H. Paulino, Atlanta, GA (US)

(73) Assignees: The Board of Trustees of the University of Illinois, Urbana, IL (US); Japan Science and Technology Agency, Saitama (JP)

( * ) Notice: Subject to any disclaimer, the term of this patent is extended or adjusted under 35 U.S.C. 154(b) by 293 days.

(21) Appl. No.: 15/896,519

(22) Filed: Feb. 14, 2018

(65) Prior Publication Data

US 2019/0381755 A1 Dec. 19, 2019

Related U.S. Application Data

(63) Continuation of application No. PCT/JP2016/073806, filed on Aug. 12, 2016.

(51) Int. Cl.
*B31D 5/04* (2017.01)
*B31B 50/00* (2017.01)
(Continued)

(52) U.S. Cl.
CPC ..... *B31D 5/04* (2013.01); *B31B 50/006* (2017.08); *B31D 5/0086* (2013.01); *E01D 4/00* (2013.01)

(58) Field of Classification Search
CPC ..... B31D 5/04; B31D 5/0086; B31B 50/006; E01D 4/00
See application file for complete search history.

(56) References Cited

U.S. PATENT DOCUMENTS 7,794,019 B2 9/2010 Hoberman

FOREIGN PATENT DOCUMENTS

JP 2012042044 A 3/2012
JP 2012116566 A 6/2012
(Continued)

OTHER PUBLICATIONS

Supplementary European Search Report dated Feb. 14, 2019 in corresponding Application No. EP 16837093, 7 pages.
(Continued)

*Primary Examiner* — Michael C Miggins
(74) *Attorney, Agent, or Firm* — Muncy, Geissler, Olds & Lowe, P.C.

(57) ABSTRACT

To provide a foldable structure to which stiffness is imparted so that non-uniform extension and contraction is inhibited even when each surface is formed of a flexible material, a manufacturing method and a manufacturing device of the foldable structure, and a non-transitory computer-readable computer medium storing a program. A foldable structure including at least two tubular structures in which the two tubular structures include a shared surface array which is continuous shared surfaces shared by each other, and a twisting characteristic in the shared surface array of one
(Continued)

tubular structure is in a direction opposite to that of the twisting characteristic in the shared surface array of the other tubular structure.

15 Claims, 17 Drawing Sheets

(51) Int. Cl.
*B31D 5/00* (2017.01)
*E01D 4/00* (2006.01)

(56) References Cited

FOREIGN PATENT DOCUMENTS

| | | | |
|---|---|---|---|
| JP | 2015033772 | A | 2/2015 |
| WO | WO2014/086132 | A1 | 6/2014 |

OTHER PUBLICATIONS

Ishida et al., "Origami-based Foldable Design Technique for Meandering Tubes by Using Conformal Transformation," The Japan Society for Industrial and Applied Mathematics, vol. 24, No. 1, 2014, pp. 43-58.

Miura et al., Foldable Cylinder, the Potential Concept for Actuators and Bellows, Dynamics & Design Conference, 2011, 6 pages.

Tachi et al., "Composite Rigid-Foldable Curved Origami Structure," Proceedings of the First Conference Transformables, 2013, 6 pages.

Tachi, T., "Freeform Rigid-Foldable Structure using Bidirectionally Flat-Foldable Planar Quadrilateral Mesh," Advances in Architectural Geometry, 2010, pp. 87-102.

Tachi, T., "Rigid-Foldable Thick Origami," ResearchGate, Jun. 2011, 11 pages.

Chen et al., "Origami of thick panels," Science, vol. 349, Issue 6246, Jul. 24, 2015, 6 pages.

FIG. 10
FIG. 10A
FIG. 10B
FIG. 10C
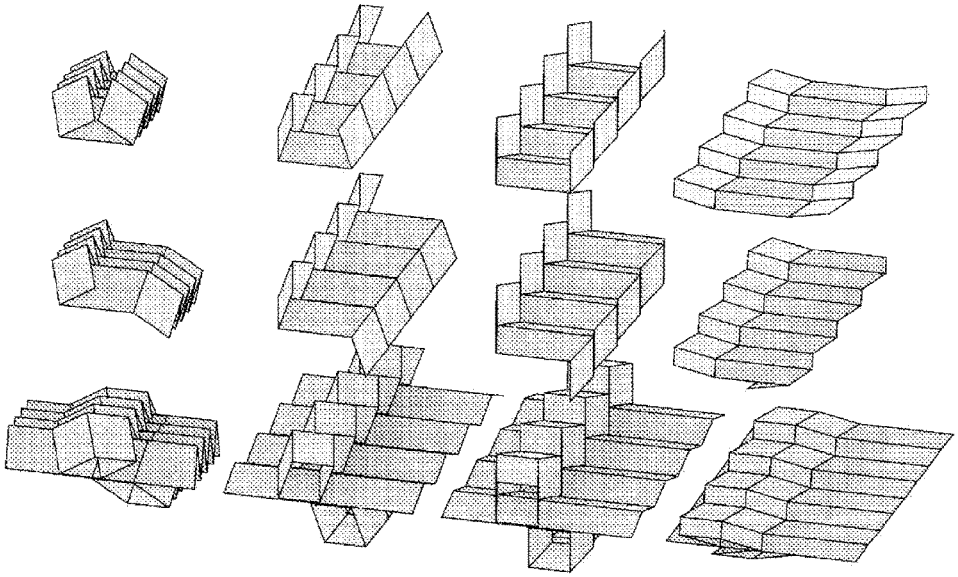
FIG. 11A
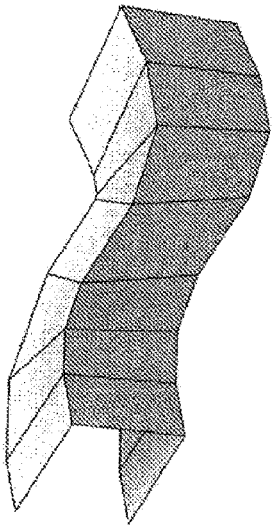
FIG. 11B
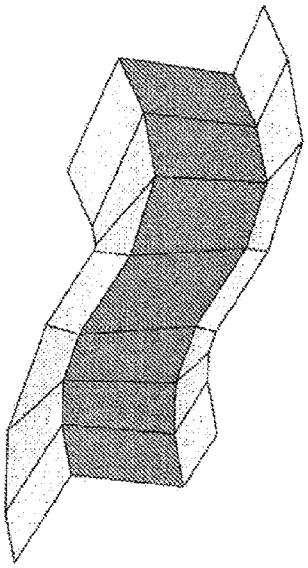
FIG. 11C
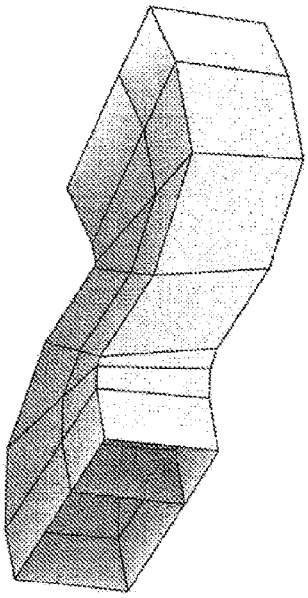

Parallel

Mirror

General Flat-Foldable

FOLDABLE STRUCTURE, METHOD OF MANUFACTURING FOLDABLE STRUCTURE, MANUFACTURING DEVICE OF FOLDABLE STRUCTURE, AND NON-TRANSITORY COMPUTER-READABLE COMPUTER MEDIUM STORING A PROGRAM

BACKGROUND OF THE INVENTION

1. Field of the Invention

The present invention relates to a foldable structure, a method of manufacturing a foldable structure, a manufacturing device of a foldable structure, and a non-transitory computer-readable computer medium storing a program.

2. Description of the Related Art

A foldable structure deformable between a folded state and a deployed state is conventionally known.

For example, Patent Document 1 discloses a tubular folding box structure easy to fold with a deployable structure referred to as a Miura-ori as a basic element.

In addition, Non-Patent Document 1 discloses an arch-shaped structure rigid-foldable with one degree of freedom and having flat-foldability.

In addition, Non-Patent Document 2 discloses a structure rigid-foldable with one degree of freedom having bidirectional flat-foldability formed of a flat quadrilateral mesh.

[Patent Document 1] JP 2012-116566 A

[Non-Patent Document 1] Tomohiro Tachi, "Composite Rigid-Foldable Curved Origami Structure", Proceedings of the First Conference Transformables 2013. In the Honor of Emilio Perez Pinero, 18-20 Sep. 2013, School of Architecture, Seville, Spain EDITORIAL STARBOOKS.

[Non-Patent Document 2] Tomohiro Tachi, "Freeform Rigid-Foldable Structure using Bidirectionally Flat-Foldable Planar Quadrilateral Mesh", Advances in Architectural Geometry 2010, pp 87-102

SUMMARY OF THE INVENTION

However, the conventional foldable structure becomes a mechanism with one degree of freedom and is rigid-foldable when each surface is a rigid body that is not bent, but there is a problem that in a case where a flexible material such as paper, a plastic plate, and a thin metal plate is used for each surface, each surface bends to occur non-uniform extension and contraction, so that the rigid-folding deformation mode cannot be maintained.

The present invention is achieved in view of the above-described problems, and a general purpose thereof is to provide a foldable structure to which stiffness is imparted so as to inhibit non-uniform extension and contraction even with a flexible material, a method of manufacturing a foldable structure, a manufacturing device of a foldable structure, and a non-transitory computer-readable computer medium storing a program.

In order to achieve such a puropse, a foldable structure according to the present invention is a foldable structure provided with at least two tubular structures, in which the two tubular structures include a shared surface array which is continuous shared surfaces shared by the two tubular structures, and a twisting characteristic in the shared surface array of one tubular structure is in a direction opposite to the direction of the twisting characteristic in the shared surface array of the other tubular structure.

Also, the foldable structure according to the present invention is the above-described foldable structure in which the tubular structures are such that, in a case of transition between a deployed state and a folded state, a propagation amount of a fold angle around the shared surface through one tubular structure is equal to the propagation amount through the other tubular structure.

Also, the foldable structure according to the present invention is the above-described foldable structure in which the shared surface array is a cylindrical surface in which the shared surfaces are connected by parallel ridge lines, and a wall surface array of one tubular structure is such that the extension of the wall surface to the other side so as to penetrate the cylindrical surface is mirror symmetric with the wall surface array of the other tubular structure with respect to a plane orthogonal to the cylindrical surface.

Also, the foldable structure according to the present invention is the above-described foldable structure in which the shared surface array is an arbitrary single curved surface, and an internal angle at a tetravalent vertex formed of the shared surface array and the wall surface array of the adjacent tubular structure is such that the sum of opposite angles is 180° or the opposite angles are equal to each other, and a propagation amount of the fold angle through one wall surface array is equal to the propagation amount of the fold angle through the other wall surface array.

Also, the foldable structure according to the present invention is the above-described foldable structure in which the two tubular structures are Miura-ori tubular structures, and one tubular structure and the other tubular structure are zipper-coupled such that fold line portions intermesh with each other in the shared surface array.

Also, the foldable structure according to the present invention is the above-described foldable structure in which in a case of transition from a folded state to a deployed state, the tubular structures which are not adjacent to each other so far are adjacent and may be coupled, so that retransition to the folded state may be inhibited.

Also, the foldable structure according to the present invention is the above-described foldable structure in which a surface of the shared surface array is a conceptual surface formed of a plurality of fold lines.

Also, the foldable structure according to the present invention is the above-described foldable structure in which the foldable structure is a folding structure or a flat-foldable structure.

Also, a method of manufacturing a foldable structure according to the present invention is provided with a foldable structure generating step of generating an equivalent foldable structure including two wall surface arrays from a generating surface array, and a tubular structure forming step of forming tubular structures on both sides of the generating surface on the basis of the generating surface array and the two wall surface arrays.

Also, the method of manufacturing a foldable structure according to the present invention is the above-described method of manufacturing a foldable structure in which the foldable structure generating step generates the generating surface array as a cylindrical surface connected by parallel ridge lines, generates a wall surface array mirror symmetric with an arbitrary wall surface array with respect to a plane orthogonal to the cylindrical surface, and generates the equivalent foldable structure by extending one wall surface array so as to penetrate the generating surface array, and the tubular structure forming step forms the tubular structures from surface arrays offset in parallel on both sides of the generating surface array and surface arrays offset in parallel from the wall surface arrays.

Also, the method of manufacturing a foldable structure according to the present invention is the above-described method of manufacturing a foldable structure in which the foldable structure generating step generates the equivalent foldable structure by determining an internal angle at each inner vertex such that the sum of opposite angles is 180° and a propagation amount of a fold angle through one wall surface array is equal to the propagation amount of the fold angle through the other wall surface array in a deployment diagram of the foldable structure including the generating surface array and the two wall surface arrays, and the tubular structure forming step forms the tubular structures of surface arrays offset in parallel on both sides of the generating surface array and surface arrays offset in parallel from the wall surface arrays.

Also, a manufacturing device of a foldable structure according to the present invention is provided with a foldable structure generator which generates an equivalent foldable structure including two wall surface arrays from a generating surface array, and a tubular structure former which forms tubular structures on both sides of the generating surface on the basis of the generating surface array and the two wall surface arrays.

Also, a non-transitory computer-readable computer medium storing a program according to the present invention is a non-transitory computer-readable computer medium which stores a program for allowing a computer to execute a method of generating a foldable structure which allows the computer to execute a foldable structure generating step of generating an equivalent foldable structure including two wall surface arrays from a generating surface array, and a tubular structure forming step of forming tubular structures on both sides of the generating surface on the basis of the generating surface array and the two wall surface arrays.

According to the present invention, there is an effect that it is possible to provide a foldable structure to which stiffness is imparted so as to inhibit non-uniform extension and contraction even if each surface is formed of a flexible material, a method for manufacturing a foldable structure, a manufacturing device of a foldable structure, and a non-transitory computer-readable computer medium storing a program.

BRIEF DESCRIPTION OF THE DRAWINGS

FIGS. 10A-10C are views respectively illustrating three stages of an array structure of three surface array obtained by extracting an equivalent origami structure from a folding structure of FIG. 6;

FIGS. 11A-11C are views illustrating a basic array structure and a tubular structure of a parallel surface group;

DETAILED DESCRIPTION OF THE INVENTION

An embodiment of a foldable structure according to this embodiment of the present invention, a manufacturing method and a manufacturing device of the foldable structure, a non-transitory computer-readable computer medium storing a program, and a recording medium will be hereinafter described in detail with reference to the drawings. Meanwhile, the present invention is not limited by this embodiment.

1. Foldable Structure

Figure 1A:
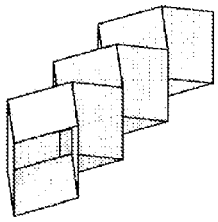
FIGS. 1A-1C are perspective views respectively illustrating (A) one Miura-ori tubular structure, (B) two aligned-coupled Miura-ori tubular structures, and (C) two zipper-coupled Miura-ori tubular structures.
Figure 1B:
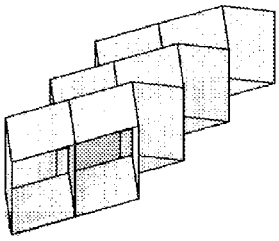
Figure 1C:
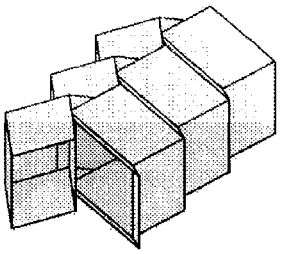
Figure 2A:
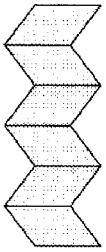
FIGS. 2A-2C are orthographic views respectively illustrating a top view (upper side) and a front view (lower side) of FIGS. 1A-1C.
Figure 2B:
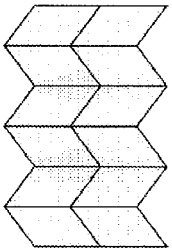
Figure 2C:
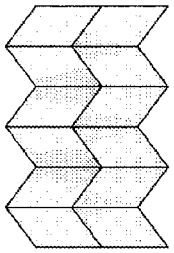
Figure 2C:
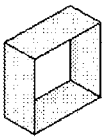
Figure 2C:
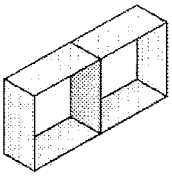
Figure 2C:
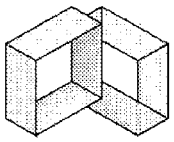

First, the embodiment of the foldable structure according to the present invention is hereinafter described, followed by the detailed description of a configuration of the manufacturing device for manufacturing the foldable structure according to this embodiment, process of the manufacturing method and the like. Meanwhile, the foldable structure is a structure which may be folded to be deformed such as a folding structure, a flat-foldable structure, or a rigid-foldable structure. Herein, FIGS. 1A-1C are perspective view respectively illustrating (A) one Miura-ori tubular structure, (B) two aligned-coupled Miura-ori tubular structures, and (C) two zipper-coupled Miura-ori tubular structures. FIGS. 2A-2C are orthographic views respectively illustrating a top view (upper stage) and a front view (lower stage) of FIGS. 1A-1C.

It is known that (A) a single Miura-ori tubular structure, and (B) the aligned-coupled structure thereof have flat-foldable property, so that they are flat-foldable, and are rigid-foldable with one degree of freedom. Herein, a "rigid-foldable structure" which is a structure rigid-foldable is a mechanism which may be continuously deformed out of structures formed of a plurality of surfaces continuous with fold lines with each surface being a rigid body not deflected.

However, in order to maintain a rigid-folding deformation mode at the time of deployment, it is necessary that each surface is not twisted, that is, a material having relatively large stiffness is used as the material of each surface. In other words, in a case where (A) the single tubular structure or (B) the aligned-coupled structures is made of a thin material, there is a problem that non-uniform extension and contraction occurs because each surface bends. Herein, FIGS. 3A-3D are views respectively illustrating the rigid-folding deformation mode (FIGS. 3A and 3B in upper stage) in which the non-uniform deformation does not occur at the time of deployment and a twist mode in which the non-uniform deformation occurs at the time of deployment (FIGS. 3C and 3D in lower stage).

Figure 3A:
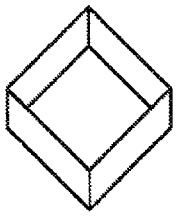
FIGS. 3A-3D are views respectively illustrating a rigid-folding deformation mode (FIGS. 3A and 3B in upper side) in which non-uniform deformation does not occur at the time of deployment, and a twisting mode in which the non-uniform deformation occurs at the time of deployment (FIGS. 3C and 3D in lower stage)
Figure 3B:
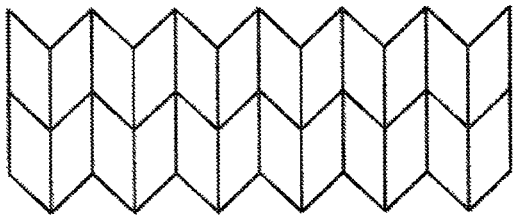
Figure 3C:
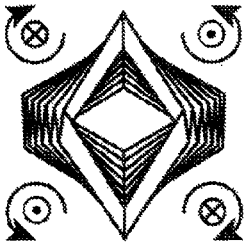
Figure 3D:
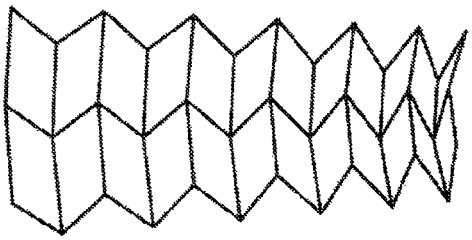

Ideally, it is desirable that the non-uniform deformation does not occur at the time of deployment and that it is possible to maintain the rigid-folding deformation mode as illustrated in FIGS. 3A and 3B in the upper stage. In a structure of a rigid panel, since this motion is interlocked as the mechanism with one degree of freedom, the deformation of a cross-section is uniform and the cross-section is subjected to shear deformation according to an extension and contraction ratio. (refer to FIG. 3B). However, actually, although the single tubular structure has a substantially parallelogram cross-section, an amount of the shear deformation of the cross-section varies as the amount of extension and contraction varies, so that the surface twists (refer to FIG. 3C). As the amount of the shear deformation of this cross-section varies as the extension and contraction ratio varies in an extension and contraction direction, twist occurs (refer to FIG. 3D). Herein, arrows in FIG. 3C indicate twisting directions, and the twist occurs alternately in positive and negative rotational directions in respective adjacent surface arrays. In a case where there is flexibility because a panel is thin or bendable in this manner, deformation in the deformation mode occurs in which the deformation of the cross-section is not the same at both ends of a tube. Such non-uniform deformation causes various problems; for example, it is not possible to drive the tube from an end or allow the same to have stiffness by fixing the end.

Figure 4:
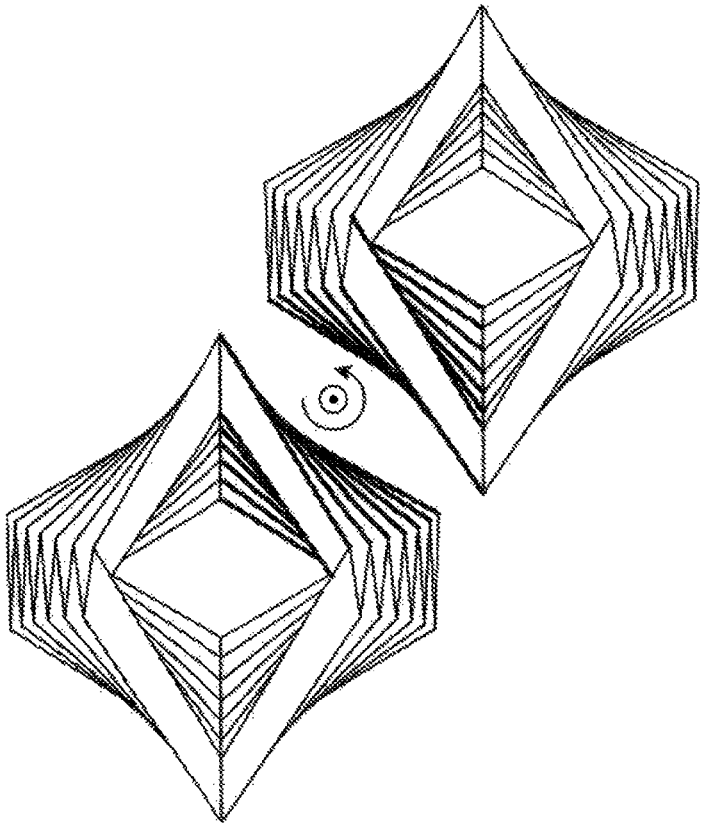
FIG. 4 is a view illustrating a twisting direction in a shared surface array of (B) aligned- coupling.

In consideration of these problems, the inventors of the present application achieved the present invention as a result of serious studies. That is, one embodiment of the present invention is, as illustrated in FIGS. 1C and 2C, the foldable structure in which one tubular structure and the other tubular structure are not aligned-coupled, but zipper-coupled such that the fold line portions alternately intermeshed. Such zipper-coupled foldable structure may prevent the non-uniform extension and contraction by a combination of geometrical structures and maintain the rigid-folding deformation mode. Herein, FIG. 4 is a view illustrating the twisting direction in a shared surface array of the (B) aligned-coupling, and FIG. 5 is a view illustrating the twisting direction in the shared surface array of the (C) zipper-coupling.

When the two tubular structures share a surface, the extension and contraction ratio and a gradient thereof are shared by the two tubes. Therefore, when the two tubular structures cause the non-uniform deformation mode, it is possible to confirm the twist mode of the shared surface. As illustrated in FIG. 4, in a case where the tubular structures are (B) aligned-coupled, the twisting directions with respect to the gradient of the extension and contraction ratio are the same. Therefore, in the (B) aligned-coupling, signs of twisting with respect to the gradient of the extension and contraction ratio are the same, permitting a non-uniform deformation mode, and causing the non-uniform deformation equivalent to that of (A) the single tubular structure.

Figure 5:
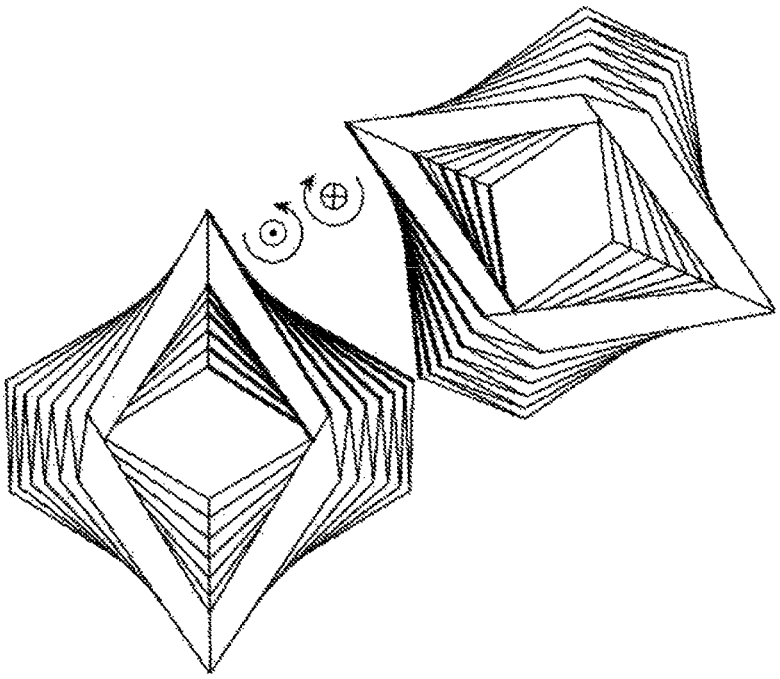
FIG. 5 is a view illustrating a twisting direction in a shared surface array of (C) zipper- coupling.

On the other hand, as illustrated in FIG. 5, in a case of (C) the zipper-coupled tubular structures, the twisting directions with respect to the gradient of the extension and contraction ratio are reversed. In this manner, in (C) the zipper-coupled foldable structure invented by the inventors of the present application, as a result of the reversal of the twist due to the gradient of the extension and contraction ratio in the shared surface array, the twists cancel each other, so that the non-uniform deformation is inhibited and structural hardness (stiffness) may be generated.

The inventors of the present application further studied seriously and found the principle of manufacturing a generalized shape maintaining the property of reversal of the twisting direction in the shared surface array with the zipper-coupled tubular structures as a basic structure. That is, they found that various shapes may be manufactured by widely generalizing the principle of positive/negative reversal of the twisting directions in addition to the combination of the Miura-ori tubular structures. The principle that the shear deformation of a parallelogram at a certain cross-sectional position corresponds to the extension and contraction ratio at that position and the gradient of the extension and contraction ratio causes the twist of the shared surface array also holds for the generalized shape. Therefore, also in the generalized shape, it is possible to exhibit equivalent functionality, that is, stiffness to prevent the non-uniform deformation at the time of deployment by focusing on the property of twist reversal in the shared surface array.

Figure 6:
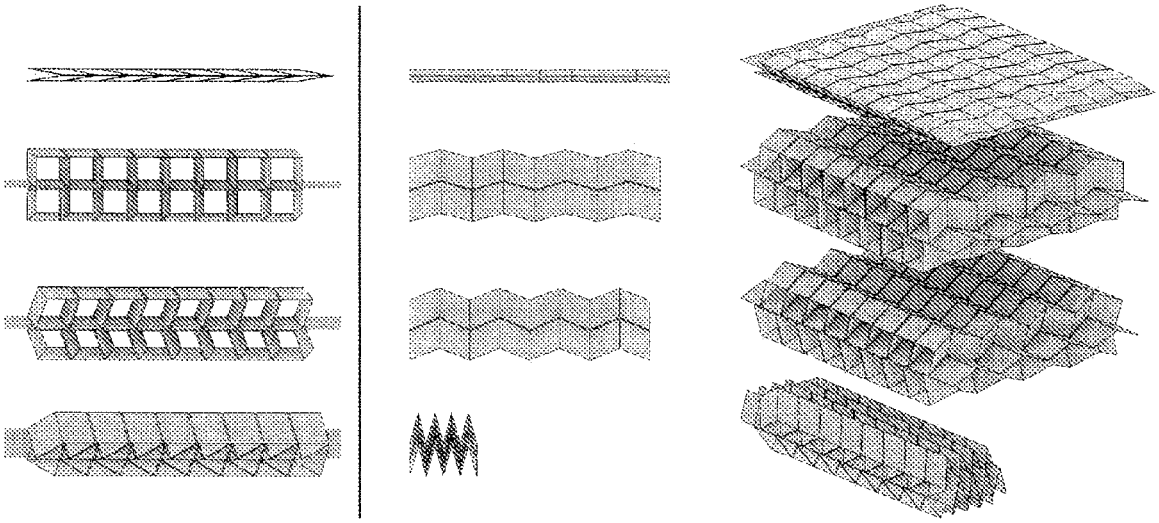
FIG. 6 is a view illustrating a bidirectionally flat-foldable waveform sandwich structure in which a large number of (C) zipper-coupled tubular structures are arranged.

Meanwhile, the single tubular shape may be generalized as follows as an example. That is, this may be a polyhedral tubular structure formed by connecting unit structures each being a tube formed of four surfaces including two pairs of parallel surfaces coupling at the cross-section or may be a curved tubular structure obtained by infinitely subdividing the same to smooth. A smooth curved tubular structure is a structure which may be defined as an envelope surface formed by two pairs of parallel surfaces moving in a space (refer to Non-Patent Document 1). The embodiment of the generalized shape according to the present invention is the one in which deforming mechanisms of the shared surface array due to extension and contraction of the two types of tubular structures are the same, out of such tubular structures sharing a quadrangular surface array in a case of a polyhedron or a single curved surface in a case of a curved tubular structure with another tubular structure. Herein, FIG. 6 is a view illustrating a waveform sandwich structure having bidirectionally flat-foldability in which a large number of (C) zipper-coupled tubular structures are arranged. Meanwhile, the shared surface is illustrated in gray (the same applies to the following drawings).

Herein, a property that the surface in the structure twists in a specific direction as the shear deformation of the cross-section becomes non-uniform with respect to the gradient of the extension and contraction ratio as described above is referred to a twisting characteristic. As illustrated in FIG. 6, this sandwich structure is obtained by combining such that the twisting characteristic of the tubular structure on an upper side of the waveform shared surface array and the twisting characteristic of the tubular structure on a lower side of the waveform shared surface array are reversed. For this reason, the stiffness is imparted as a structural characteristic due to the combination. Meanwhile, since there is no shared surface before deciding the combination, the shared plane (shared surface array) is sometimes referred to as the "generating surface (generating surface array)" in a process of generating the foldable structure. Herein, in this embodiment, the "surface" is not necessarily a physical plate-shaped surface but may be a conceptual surface formed of a plurality of fold lines such as a structural surface formed with a truss structure or a rigid-frame structure.

What is important is, when wall surface arrays are protruded to upper and lower sides from the generating surface array (shared surface array), the wall surface arrays are protruded such that they are reversed between the upper side and the lower side, and the upper tubular structure and the lower tubular structure are required to conform in the deforming mechanism. Herein, FIG. 7 is a view illustrating a deployed state and a folded state of the foldable structure which is rigid-foldable imparted with stiffness.

Figure 7:
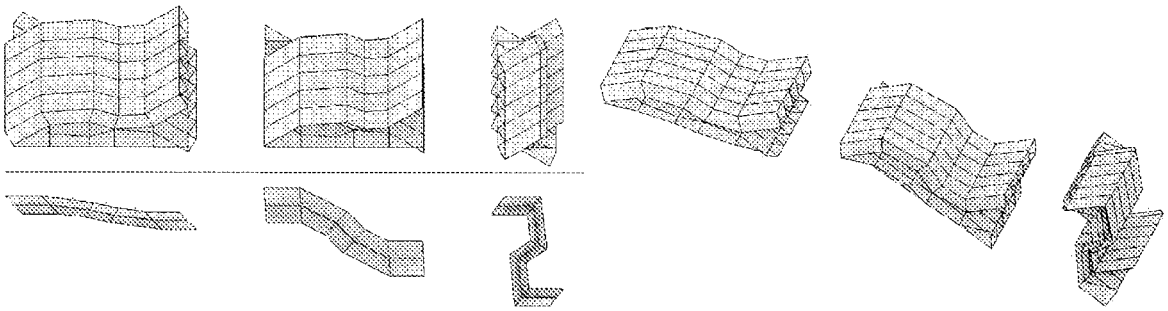
FIG. 7 is a view illustrating a deployed state and a folded state of a rigid-foldable structure imparted with stiffness.
Figure 8:
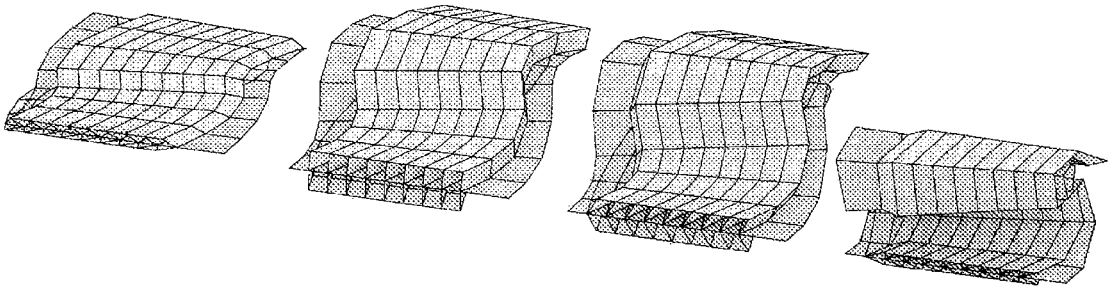
FIG. 8 is a view illustrating a sandwich structure obtained from a generating curved surface (shared surface array) of arbitrary single curved surfaces.

If the deforming mechanisms of the upper tubular structure and the lower tubular structure of the sandwich structure do not conform to each other, it is not possible to fold as illustrated in FIG. 7. On the other hand, if the wall surface arrays are protruded in the same direction on the upper side and the lower side, the deforming mechanism of the upper tubular structure and the lower tubular structure may conform to each other, but it is no more than the single structures aligned and the structural characteristics do not change, so that the stiffness by reversal in the twisting direction is not imparted. A method of resolving this problem and obtaining geometric parameters will be described later in detail. Meanwhile, FIG. 7 illustrates examples of a folding structure created with arbitrary cylindrical surfaces as generating surface arrays. Herein, FIG. 8 is a view illustrating the sandwich structure obtained from a generating curved surface (shared surface array) of an arbitrary single curved surface. FIG. 8 illustrates an example of the foldable structure created with an arbitrary deployable surface as the generating surface array.

According to the embodiment of the generalized shape according to the present invention, in a case of transition between the deployed state and the folded state as illustrated in FIG. 8, a propagation amount of a fold angle around the shared surface in a clockwise direction (case where this transmits through one wall surface array) and that in a counterclockwise direction (case where this transmits through the other wall surface array) are the same, so that it is possible to exhibit the foldability without inconsistency in the folding structure. In addition, on the upper side and the lower side of the shared surface array, the twisting directions are reversed, thereby canceling the twists, and the stiffness is imparted as a combination of the structures, so that non-uniform extension and contraction may be inhibited.

The description of an example of the foldable structure according to this embodiment herein ends. A condition, a configuration, and a manufacturing method of such foldable structure to which the stiffness is imparted at the time of deployment are also described below. Meanwhile, in the following description, it is also possible to manually perform the configuration or process described to be performed automatically, and it is also possible to automatically perform the configuration or process described to be performed manually. Although an origami structure and a folding structure might be illustrated as an example of the foldable structure in the following embodiment, the foldable structure is not limited to the origami structure and the folding structure, and may be the foldable structure capable of being folded to be deformed although this cannot be flat-folded in addition to the flat-foldable structure and the rigid-foldable structure. Therefore, in the description of this embodiment, the description of the "origami structure" may be read as the "flat-foldable structure", the "rigid-foldable structure", or the "foldable structure" to be embodied. Also, in the description of this embodiment, the description of "folding" may be read as "folding and deforming" and the "folded state" may be read as "folded and deformed state".

2. Configuration of Manufacturing Device 100

Figure 9:
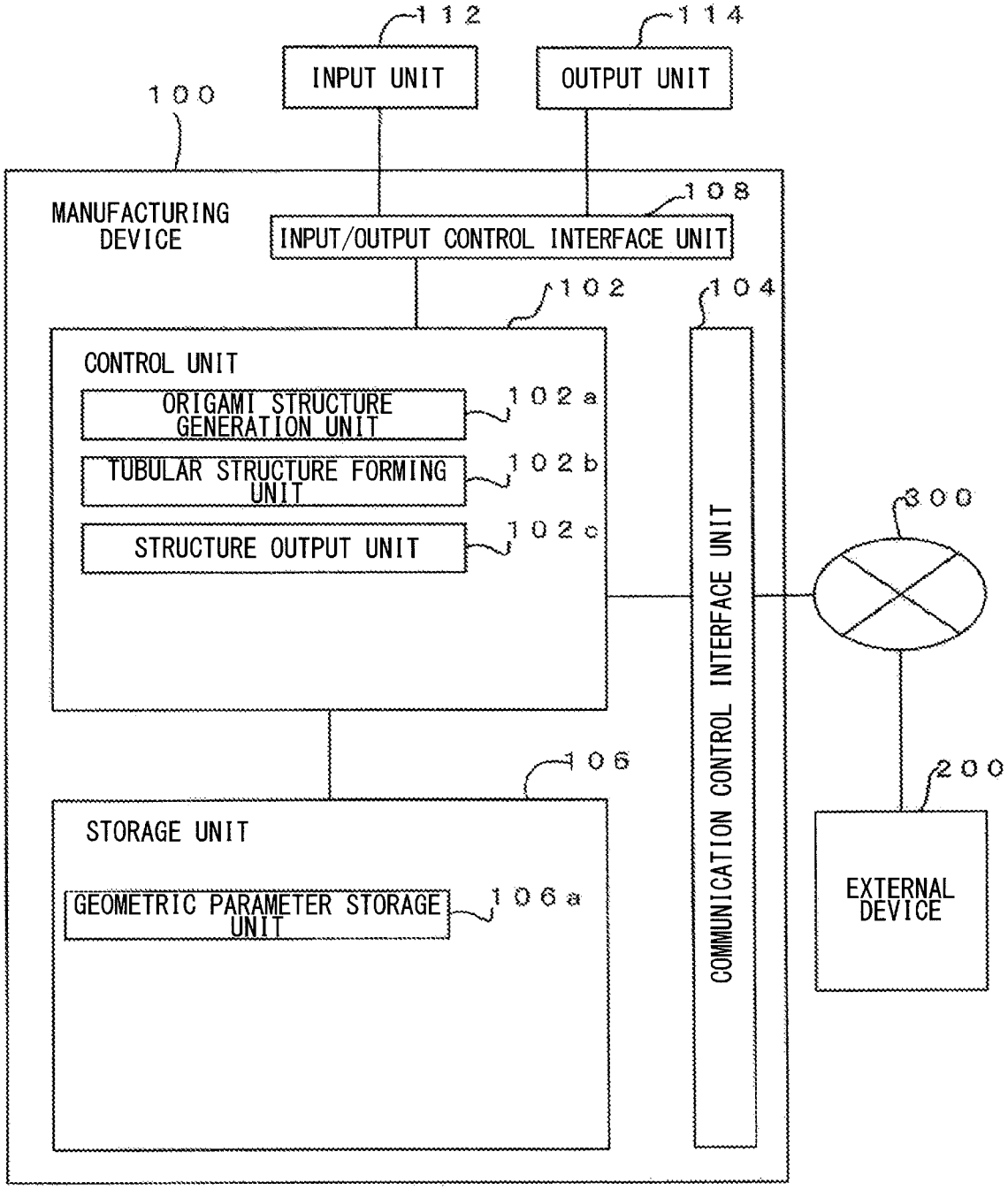
FIG. 9 is a block diagram illustrating an example of a configuration of a manufacturing device 100 to which this embodiment is applied.

Subsequently, a configuration of a manufacturing device 100 of the foldable structure according to this embodiment is described. FIG. 9 is a block diagram illustrating an example of the configuration of the manufacturing device 100 to which this embodiment is applied in which only a portion relating to this embodiment out of the configuration is schematically illustrated. Meanwhile, the manufacturing device 100 may also be equipped with well-known means of computer-aided design.

In FIG. 9, the manufacturing device 100 is schematically provided with a control unit 102 such as a CPU that comprehensively controls an entire manufacturing device 100, a communication control interface unit 104 connected to a communication device such as a router (not illustrated) connected to a communication line and the like, an input/output control interface unit 108 connected to an input unit 112 and an output unit 114, and a storage unit 106 which stores various databases, tables and the like, and the respective units are connected so as to be able to communicate via an arbitrary communication path.

Various databases and tables (geometric parameter storage unit 106*a* and the like) stored in the storage unit 106 being storage means such as a fixed disk device stores various programs, tables, files, databases, web pages and the like used for various processes.

Among them, the geometric parameter storage unit 106*a* is geometric parameter storage means which stores design conditions of the foldable structure and the geometric parameters. As an example, the geometric parameter storage unit 106*a* may store deployment diagram data of the foldable structure (for example, a diagram in which a mountain fold line, a valley fold line and the like are written in a plan view).

Also, in FIG. 9, the input/output control interface unit 108 controls the input unit 112 and the output unit 114. As the input unit 112, a keyboard, a mouse, a touch panel and the like may be used. Also, as output means of the foldable structure, the output unit 114 may be a printing machine, a 3D printer, a laser cutter and the like. As the output unit 114 as display means, a monitor (including a home television, a touch screen monitor and the like) and the like may be used.

Also, in FIG. 9, the control unit 102 includes an internal memory for storing a control program such as an operating system (OS), a program specifying various procedures and the like, and required data, and performs information processing for executing various processes by the programs and the like. The control unit 102 is functionally and conceptually provided with an origami structure generation unit 102*a*, a tubular structure forming unit 102*b*, and a structure output unit 102*c*.

Among them, the origami structure generation unit 102*a* is foldable structure generating means that generates an equivalent origami structure including two wall surface arrays from the generating surface array that will later become a shared surface array as an example of the foldable structure. Meanwhile, the origami structure generation unit 102*a* may generate the foldable structure such as the flat-foldable structure and the rigid-foldable structure in addition to the equivalent origami structure. Herein, the geometric parameters of the foldable structure such as the origami structure, the flat-foldable structure, and the rigid-foldable structure generated by the origami structure generation unit 102*a* are stored in the geometric parameter storage unit 106*a*. Herein, in this embodiment, two types of conformity conditions for generating the equivalent origami structure including the two wall surface arrays from the generating surface array are exemplified. Herein, FIGS. 10A-10C are views illustrating an array structure of three surface arrays obtained by extracting the equivalent origami structure from the folding structure in FIG. 6.

Conformity Condition of Deforming Mechanism

In order to deal with the conformity condition of a specific deforming mechanism, a complicated folding structure is simplified and only a unit structure is considered. A lower stage (SA-3) in FIG. 10C is an extraction of the shared surface array, one tubular structure on the upper side and one tubular structure on the lower side from the sandwich structure in FIGS. 3A-3D.

The tubular structures on the upper and lower sides of the shared surface array of the sandwich structure illustrated in FIG. 6 may be defined by a normal direction of the wall surface array which is the array of the surfaces in contact with the shared surface array. Therefore, it is only necessary to consider an array structure in which three arrays of the wall surface array on one side, the shared surface array, and the wall surface array on the other side are connected as in an intermediate stage (SA-2) in FIG. 10B by further simplifying the same. Since only the normal direction of the wall surface array is important, even if this is extended to the opposite side of the shared surface as in an upper stage (SA-1) in FIG. 10A, a property of the deforming mechanism is maintained, so that the one only the wall surface on one side of which is extended is made a basic array structure for examining the conformity condition to be described below. Also, in a case where the wall surface arrays on both sides self-intersect, the property of the deforming mechanism is maintained even if the array structure without self-intersection is made by appropriately translating the respective surfaces without changing the normal direction. In the array structure thus modeled, there are following three conformity conditions capable of conforming the deforming mechanisms of three quadrangle arrays.

Conformity Condition 1 of Deforming Mechanism

FIGS. 11A-11C are views illustrating the basic array structure and the tubular structure by a parallel surface group. As illustrated in FIGS. 11A-11C, in a case where the right and left wall surface arrays are parallel to each other, the fold lines formed between the same and the shared surface array also become parallel to each other and the deforming mechanisms of the two tubular structures conform to each other. However, since the right and left wall surface arrays are parallel to each other, the normal directions of the three types of surface groups are substantially two types, so that this is structurally equivalent to that of the single tubular structure. That is, although the deforming mechanisms of the two tubular structures conform to each other, the twisting characteristic in the shared surface are also in the same direction, so that the stiffness is not imparted at the time of deployment and the non-uniform deformation is not inhibited. Therefore, this conformity condition 1 is rejected from this embodiment.

Conformity Condition 2 of Deforming Mechanism

Figure 12A:
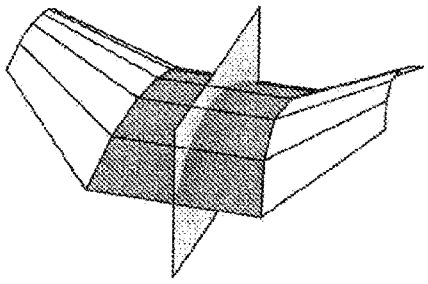
FIGS. 12A-12C are views illustrating a basic array structure and a tubular structure of a mirror symmetric surface group.
Figure 12B:
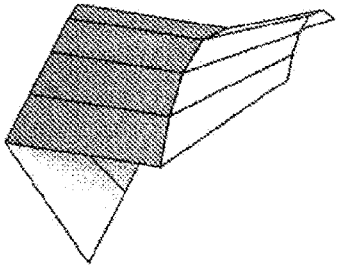
Figure 12C:
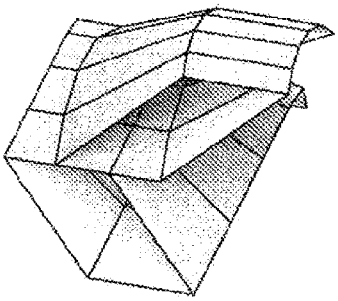

FIGS. 12A-12C are views illustrating the basic array structure and the tubular structure by a mirror symmetric surface group. As illustrated in SA-1 of FIG. 12A, in a case where the shared surface array is a cylindrical surface (ridge lines connecting the surfaces are parallel to one another), and the wall surface arrays on both sides are mirror symmetric with respect to a plane orthogonal to the cylindrical surface, the deforming mechanisms of the two tubular structures conform to each other. At that time, the twisting characteristic is reversed due to a mirror symmetric property, and the stiffness to inhibited the non-uniform deformation is imparted. Meanwhile, at that time, the fold line formed by the shared surface array and the wall surface array also becomes mirror symmetric, and the non-uniformity of the fold line is reversed.

Conformity Condition 3 of Deforming Mechanism

Figure 13A:
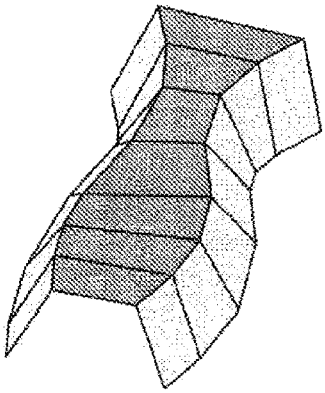
FIGS. 13A-13C are views illustrating a basic array structure and a tubular structure under a bidirectionally flat-foldable condition.
Figure 13B:
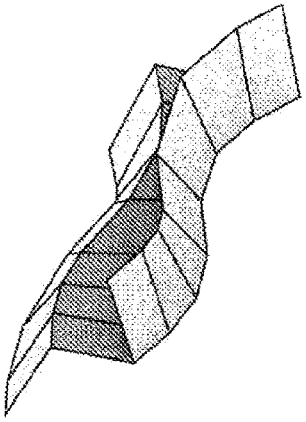
Figure 13C:
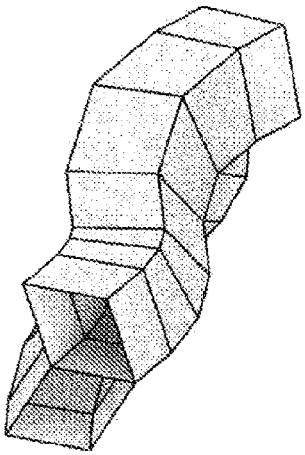
Figure 14A:
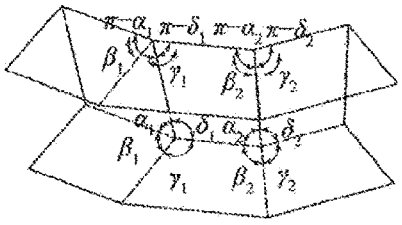
FIGS. 14A-14C are views illustrating a relationship between internal angles of respective surfaces when conformity conditions 1, 2, and 3 of a deforming mechanism are satisfied.

FIGS. 13A-13C are views illustrating the basic array structure and the tubular structure according to a bidirectionally flat-foldable condition. As for an internal angle at each internal vertex of a 3×n array structure in which the shared surface array is a free single curved surface in order to satisfy the bidirectionally flat-foldable condition, the sum of opposite angles should be 180°, or the opposite angles should be equal and a dihedral angle at the ridge line should not be 0° or 180°. Meanwhile, in a case where the opposite angles are equal at the vertex of a boundary between the wall surface and the shared surface, the sum of the opposite angles is 180° in a case where the wall surface is extended while maintaining the conformity of the mechanism. In a case of a smooth curved surface, it is required that it is deployable on a curved fold line on the boundary between the wall surface and the shared surface, and the angle formed by a generatrix and a tangent line of the fold line is equal on the right and left sides across the fold line (the generatrix is in a mirror symmetric position with respect to the curved line in the deployment diagram) or the wall surface is extended to the opposite side of the shared surface. In this embodiment, a smooth curved tubular structure is a structure which may be defined as an envelope surface formed by two pairs of parallel surfaces moving in space (refer to Non-Patent Document 1), and a line on the shared surface array at each position when the curved surface is formed by the parallel surfaces is referred to as the generatrix. Meanwhile, it is not required that an entire structure of the foldable structure generated under the conformity condition 3 is symmetrical. Herein, there is a case where positivity and negativity of the non-uniformity of the connecting fold line of one wall surface array and the shared surface array is equal or reverse to that of the non-uniformity of the other wall surface array and the shared surface array. Herein, in a case where the positivity and negativity of the non-uniformity are equal, the relation of the twisting characteristic is substantially equal to that of the aligned-coupling, and since the stiffness is not imparted at the time of deployment, this is rejected from this embodiment. When the positivity and negativity of the non-uniformity of the fold line is reversed, the relationship of the twisting characteristic becomes substantially equal to that of the mirror symmetric arrangement, so that the stiffness is imparted. Herein, FIGS. 14A-14C are views illustrating the relationship of the internal angles of the respective surfaces when the conformity conditions 1, 2, and 3 of the deforming mechanism are satisfied from the left, respectively.

Figure 14B:
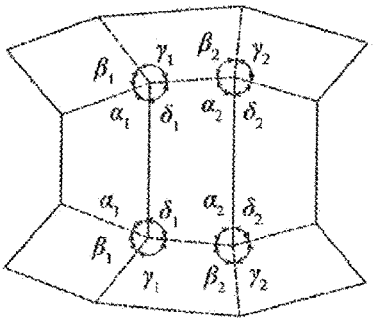

As illustrated in FIG. 14B, under the conformity condition 2 of the deforming mechanism, the ridge lines of the shared surface are parallel, the fold lines and the internal angles of the shared surface array and the right and left wall surface arrays are the same on the right and left sides, so that this is a line-symmetric figure in the deployment diagram. As an example, the origami structure generation unit 102*a* may generate the array structure so as to satisfy the conformity condition 2 of the deforming mechanism to generate the equivalent origami structure.

Figure 14C:
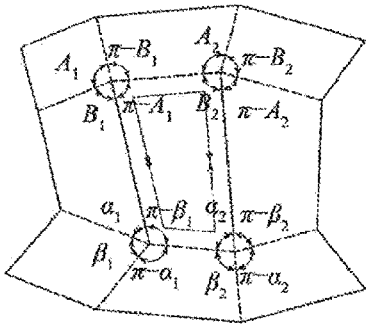

Also, as illustrated in FIG. 14C, under the conformity condition 3 of the deforming mechanism, in the deployment diagram, the sum of the opposite angles is 180° as for the internal angle at each internal vertex. That is, as illustrated in FIG. 14C, an opposite angle of an internal angle A1 is π-A1, and an opposite angle of an internal angle B1 is n-B1. Also, an opposite angle of an internal angle A2 is π-A2, and an opposite angle of an internal angle B2 is π-B2. Also, as for the other side surface array, an opposite angle of an internal angle α1 is π-α1 and an opposite angle of an internal angle β1 is π-β1 as illustrated. Also, an opposite angle of an internal angle α2 is π-α2, and an opposite angle of an internal angle β2 is π-β2. Meanwhile, on the contrary, when if π-A1, π-B1, π-A2, π-B2, π-α1, π-β1, and π-β2 illustrated in the drawing are considered as the internal angles, the opposite angles thereof are A1, B1, A2, B2, α1, β1, α2, and β2, respectively, and the sum of the opposite angles is 180°. As an example, the origami structure generation unit 102*a* may generate the array structure by determining the internal angle such that the propagation amount of the fold angle through one wall surface array and the propagation amount of the fold angle through the other wall surface array are equal to each other while setting the sum of the opposite angles to 180° as for the internal angle at each internal vertex. Meanwhile, a method of calculating the propagation amount will be described later in detail.

As an example, as described above, the origami structure generation unit 102*a* may generate the equivalent origami structure by generating the array structure including the generating surface array and the two wall surface arrays. Meanwhile, in a case where the two wall surface arrays are generated on the same side with respect to the generating surface array as in SA-1, the origami structure generation unit may extend one of the wall surface arrays so as to penetrate the generating surface array as in SA-2, thereby generating the wall surface arrays on the upper and lower sides of the generating surface array to generate the equivalent origami structure.

Specifically, in a case of the structure under the conformity condition 2, as an example, the origami structure generation unit 102*a* generates a structure duplicated mirror symmetric with respect to an arbitrary plane perpendicular to the cylindrical surface in which an arbitrary trapezoidal array is connected to the generating surface array (shared surface array) being the cylindrical surface to make the same the wall surface array on one side (refer SA-1 in FIG. 12A). In this case, the origami structure generation unit 102*a* may also generate the other wall surface array by extending the duplicated surface array to the opposite side across the generating surface (shared surface) (refer to SA-2 in FIG. 12B). Even if the extension operation as described above is performed, the property of the structure does not change, so that the conformity of the deforming mechanism is maintained.

Returning to FIG. 9 again, the tubular structure forming unit 102*b* is tubular structure forming means of forming the tubular structures on both sides of the generating surface being the shared surface on the basis of the equivalent origami structure (combination of the generating surface array and the two wall surface arrays) generated by the origami structure generation unit 102*a*. Specifically, the tubular structure forming unit 102*b* may also form the tubular structure of the surface arrays offset in parallel on both sides of the generating surface array and the surface arrays offset in parallel from the respective wall surface arrays (refer to operation from SA-2 to SA-3 in FIGS. 10B, 10C, 11B, 11C, 12B, 12C, 13B and 13C described above).

For example, in a case where the origami structure generation unit 102*a* generates the equivalent origami structure satisfying the conformity condition 2 (refer to SA-1 and SA-2 in FIGS. 12A and 12B), the tubular structure forming unit 102*b* may translate the wall surface array in the generatrix direction of the cylindrical surface to copy and connect an upper surface by a surface array parallel to the generating surface, thereby making the tubular structure on one surface as illustrated in SA-2 and SA-3 in FIGS. 12B and 12C. The origami structure generation unit 102*a* may perform the equivalent operation to the opposite side to obtain the tubular structures on both sides.

Also, for example, in a case where the origami structure generation unit 102*a* generates the equivalent origami structure satisfying the conformity condition 3 (refer to SA-1 and SA-2 in FIGS. 13A and 13B), the tubular structure forming unit 102*b* creates the tubular structure from the generating surface array (shared surface array) and the wall surface array generated by the origami structure generation unit 102*a*. Specifically, the tubular structure forming unit 102*b* may offset the generating surface array (shared surface array) by a fixed distance (operation of making a surface equidistant from the surface and reconfiguring a surface array connecting them), or offset the wall surface array by a certain distance, thereby creating two pairs of parallel surface arrays. Then, the tubular structure forming unit 102*b* may form the tubular structure by connecting them.

Meanwhile, the tubular structure forming unit 102*b* may also form a cellular structure by forming a plurality of parallel surface arrays on one side of the generating surface (shared surface) by repeatedly executing the offset operation. The tubular structure on one side of the shared surface array may be coupled by the equivalent operation as that of well-known aligned-coupling. Meanwhile, the geometric parameters of the tubular structure formed by the tubular structure forming unit 102*b* as described above are stored in the geometric parameter storage unit 106*a*.

Herein, the tubular structure forming unit 102*b* may adjust a design according to a thickness of the material of the foldable structure to be manufactured. That is, in a case where the material of the foldable structure to be manufactured is thin like paper, the foldability is obvious, but in a case where the thickness of the material is equal to or larger than a predetermined value, it is not possible to bend the same as designed. Therefore, the tubular structure forming unit 102*b* may adjust the design so that the thickness does not interfere at a portion to be folded and deformed. In a case of a thick stiff material, there are a hinge shift method and a volume trim method in order to secure the foldability; the tubular structure forming unit 102*b* may adjust the design by using a well-known hinge shift method (refer to U.S. Pat. No. 7,794,019, Yan Chen, Rui Peng, Zhong You, "Origami of thick panels" Science, 349 (6246), 2015 and the like), or the well-known volume trim method (refer to Tachi T. "Rigid-Foldable Thick Origami", Origami 5. Fifth International Meeting of Origami Science, Mathematics, and Education, A K Peters/CRC Press 2011, Pages 253 to 263 and the like).

Also, the structure output unit 102*c* is structure output means which manufactures the foldable structure by outputting composite data of the tubular structure formed by the tubular structure forming unit 102*b* to the output unit 114. For example, the structure output unit 102*c* may print-out the deployment diagram data formed by the tubular structure forming unit 102*b* and stored in the geometric parameter storage unit 106*a* to the output unit 114 of the printer. Also, the structure output unit 102*c* may manufacture a foldable three-dimensional structure by outputting foldable structure data formed by the tubular structure forming unit 102*b* to the output unit 114 as a 3D printer. Also, on the basis of the deployment diagram data formed by the tubular structure forming unit 102*b*, the structure output unit 102*c* may cut out a deployment diagram shape from a metal plate by the output unit 114 such as a laser cutter. Meanwhile, the foldable structure may be manufactured by coupling the respective surfaces manually or automatically by an industrial robot or the like.

Also, in FIG. 9, the communication control interface unit 104 is a device that performs communication control between the manufacturing device 100 and a network 300 (or a communication device such as a router). That is, the communication control interface unit 104 has a function of communicating data with another external device 200 or a station via a communication line (regardless of whether this is wired or wireless). Meanwhile, the network 300 has a function of mutually connecting a manufacturing device 100 and the external device 200, and is, for example, the Internet or the like.

Meanwhile, the manufacturing device 100 may be connected so as to be able to communicate with the external device 200 that provides various databases such as generating curved surfaces and geometric parameters, an external program such as a program according to the present invention and the like via the network 300. Also, the manufacturing device 100 may be connected to the network 300 so as to be able to communicate via the communication device such as the router and a wired or wireless communication line such as a dedicated line.

Also, in FIG. 9, the external device 200 may be mutually connected to the manufacturing device 100 via the network 300, and have a function of providing an external database relating to the data such as the geometric parameters and a website executing an external program and the like such as a program to the user. Herein, the external device 200 may be configured as a WEB server, an ASP server or the like, and a hardware configuration thereof may include an information processing device such as commercially available workstation, personal computer and the like, and its accessory device. Also, each function of the external device 200 is realized by a CPU, a disk device, a memory device, an input device, an output device, a communication control device and the like in the hardware configuration of the external device 200, a program for controlling them and the like.

The description of the configuration of the manufacturing device 100 of the foldable structure according to this embodiment herein ends.

3. Process of Manufacturing Method

Figure 15:
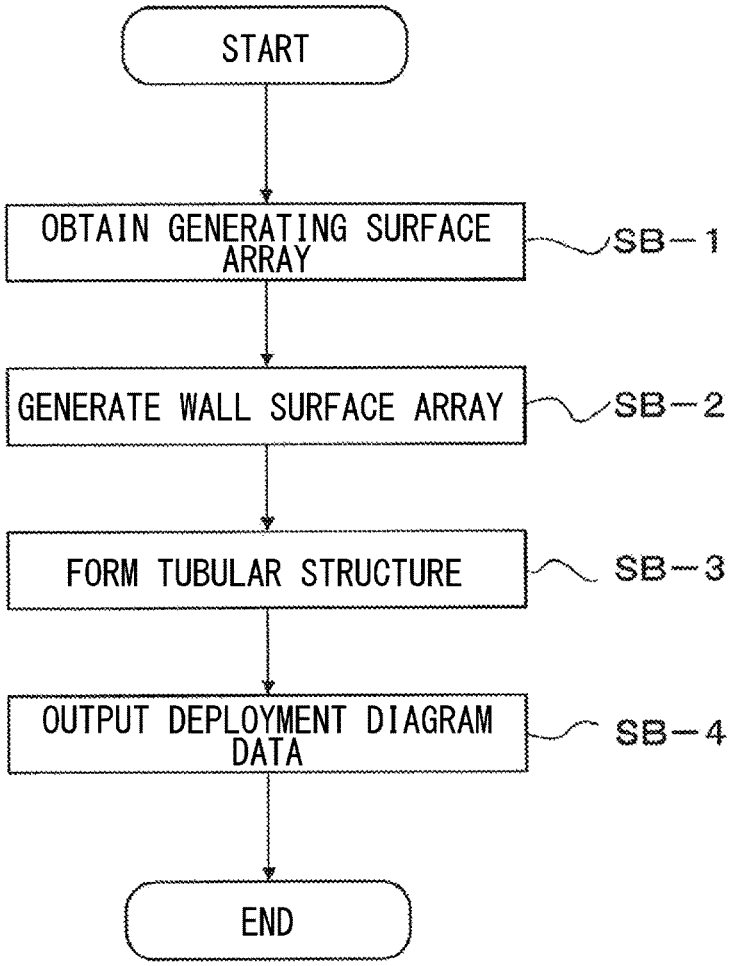
FIG. 15 is a flowchart illustrating an example of a process for manufacturing the foldable structure under the conformity condition 2 in the manufacturing device 100 of this embodiment.

Next, an example of a process of the manufacturing device 100 of the foldable structure in this embodiment thus configured will be hereinafter described in detail with reference to FIGS. 15 to 18. FIG. 15 is a flowchart illustrating an example of the process for manufacturing the foldable structure under the conformity condition 2 in the manufacturing device 100 of this embodiment.

As illustrated in FIG. 15, the origami structure generation unit 102*a* of the manufacturing device 100 first obtains an arbitrary cylindrical surface as the generating surface array (step SB-1). Herein, the origami structure generation unit 102*a* may control the user to input a curve or a curvature via the input unit 112, or may obtain a cylindrical surface that approximates the input curvature or curve as the generating surface array. A well-known geometric approximation method may also be used to obtain the cylindrical surface approximating the curvature and the curve.

The origami structure generation unit 102*a* connects an arbitrary trapezoidal array to the generating surface array formed as the cylindrical surface to make the same the wall surface array on one side and generates a structure duplicated mirror symmetric with respect to an arbitrary plane perpendicular to the cylindrical surface as the wall surface array on the other side (step SB-2). Meanwhile, since the obtained two wall surface arrays are on the same side with respect to the shared surface, the origami structure generation unit 102*a* extends one of the duplicated wall surface arrays to the opposite side across the shared surface, thereby generating the other wall surface array.

Then, the tubular structure forming unit 102*b* translates the wall surface array in a generatrix direction of the cylindrical surface to be duplicated on the basis of the generating surface and the two wall surface arrays generated by the origami structure generation unit 102*a*, and connects the upper surface by a surface array parallel to the generating surface, thereby generating the tubular structure on one surface (step SB-3). Meanwhile, the origami structure generation unit 102*a* obtains the tubular structures on both sides by applying the equivalent operation also to the opposite side.

Then, the structure output unit 102*c* outputs the deployment diagram data of the foldable structure formed by the tubular structure forming unit 102*b* to the output unit 114 such as a printing machine, a 3D printer, a laser cutter and the like, thereby manufacturing the foldable structure (step SB-4).

The above is an example of the process of manufacturing the foldable structure satisfying the conformity condition 2.

Example of Process for Satisfying Conformity Condition 3

Figure 16A:
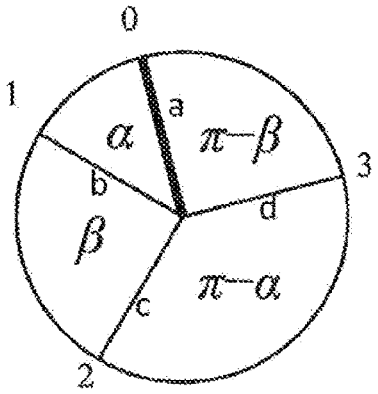
FIGS. 16A-16C are views illustrating a tetravalent vertex where the sum of opposite angles is 180°.
Figure 16B:
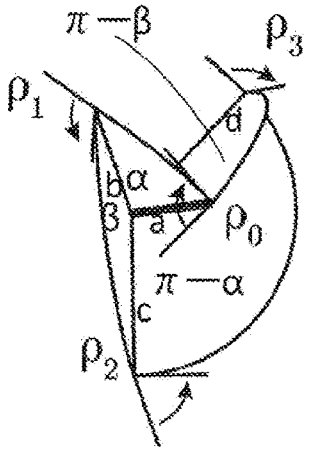
Figure 16C:
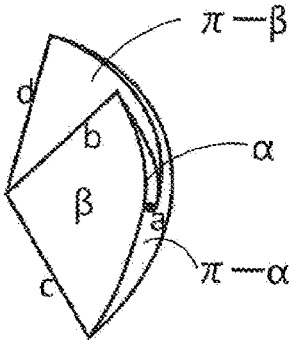

Next, in order to describe an example of the process for manufacturing the foldable structure under the conformity condition 3, calculation of the propagation amount of the fold angle is first described. Herein, FIGS. 16A-16C are views illustrating a tetravalent vertex where the sum of the opposite angles is 180°. Meanwhile, for a method of calculating the propagation amount of the fold angle described below, Non-Patent Document 2 may also be referred to.

A required overall mechanism is that the mechanism of the tetravalent vertex (where the four fold lines are collected) is interlocked without inconsistency. The tetravalent vertex already is the mechanism with one degree of freedom. That is, when the angle of one fold line is determined, the angles of the remaining fold lines are also determined. Therefore, the fold angle propagates from one tetravalent vertex to another, and all fold angles are determined.

At that time, around the surface (panel) surrounded by the fold lines a, b, c, and d, a loop in which, when the angle of the fold line a is determined, b, c, and d are determined in this order and d determines a is made. It is necessary that a condition of returning to an original state when the propagation of the fold angle goes around is established for each internal panel (a panel in which all vertices are tetravalent vertices).

When the angle of the fold line is represented by a tangent $\tan(\rho/2)$ of half a fold angle (complement of dihedral angle), the fold angle of the four fold lines around the tetravalent vertex satisfying the conformity condition 3 is as follows (refer to Non-Patent Document 2).

[Equation 1]

Meanwhile, $k(\alpha,\beta)$ is a coefficient representing the amount of propagation of fold angles of adjacent fold lines; since a transmission amount becomes equal in the clockwise direction and in the counterclockwise direction as indicated by joining two arrows in FIG. 14C only when the conformity condition 3 is satisfied, this is the constant uniquely determined only with respect to the internal angle of the surface and does not change due to the folding deformation.

[Equation 2]

The condition under which the motion of the deforming mechanism conforms is that an identity in which one quadrangular panel may be deformed with each fold angle propagating at the four vertices maintaining this relationship at each of these vertices is established. That is, in the quadrangle at the center of FIG. 14C described above, the following equation must be established.

[Equation 3]

Herein, if equation (3) is satisfied in all internal quadrangles, the deforming mechanism is established, and the tangent of half a fold angle pi of all fold lines in the model changes while preserving the ratio of each other. This change may be expressed by the following equation using a parameter t: $0 \rightarrow \infty$.

[Equation 4]

Herein, K1, K2, . . . , and Kn are constants.

From this, the following simplified condition may be obtained. That is, it is a three-dimensional shape in which the sum of the opposite angles is 180° and the fold angle is not 0. If at least one such three-dimensional shape may be obtained, if the state is set to t=1 and tangent of half the fold angle is set to K1, K2, . . . , and Kn, the deforming mechanism is determined as (K1, K2, . . . , and Kn)t.

Figure 17A:
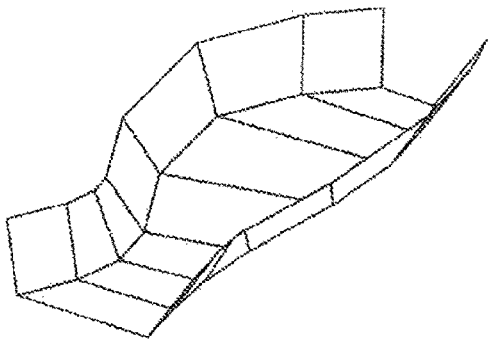
FIGS. 17A and 17B are views illustrating an example of a structure in which surface groups are generated on both sides one at a time from a generating surface.
Figure 17B:
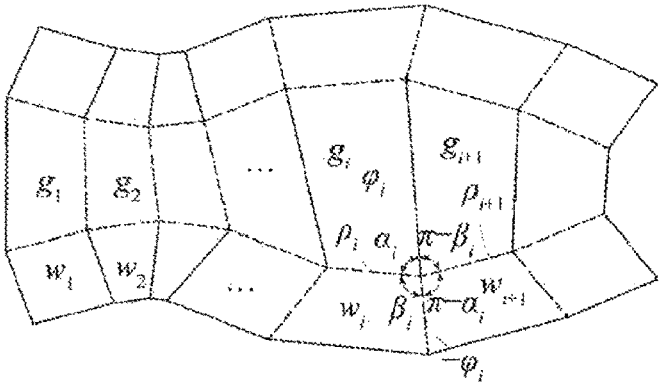
Figure 18:
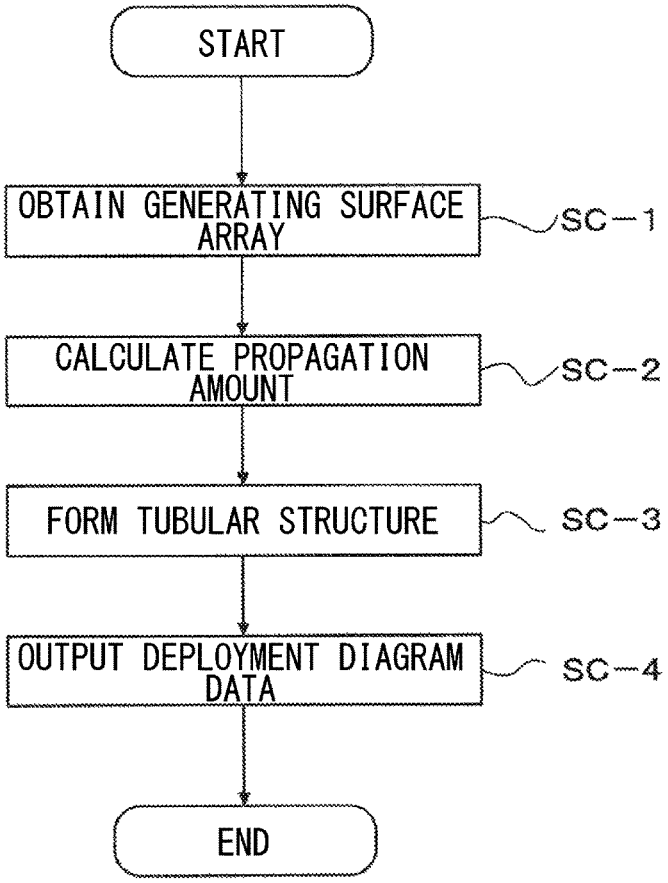
FIG. 18 is a flowchart illustrating an example of a process for manufacturing the foldable structure under the conformity condition 3 in the manufacturing device 100 of this embodiment.

The explanation of the method of calculating the propagation amount herein ends. By determining the internal angle so that the propagation amount of the fold angle via one wall surface array and the propagation amount of the fold angle via the other wall surface array are equal to each other in this manner, it is possible to generate the equivalent origami structure. Herein, FIGS. 17A and 17B are views illustrating an example of a structure in which surface groups are generated on both sides from the generating surface one after another. FIG. 18 is a flowchart illustrating an example of a process for manufacturing the foldable structure under the conformity condition 3 in the manufacturing device 100 of this embodiment.

As illustrated in FIG. 18, the origami structure generation unit 102*a* of the manufacturing device 100 first obtains an arbitrary curved surface as the generating surface array (step SC-1). Herein, the origami structure generation unit 102*a* may control the user to input the curve or the curvature via the input unit 112, or may obtain continuous flat surfaces approximating the input curvature or curve as the generating surface array. A well-known geometric approximation method may also be used for obtaining continuous flat surfaces approximating the curvature or the curve.

Then, the origami structure generation unit 102*a* determines wall surface arrays w1, w2, . . . , and wn one side at a time such that the propagation amount of the fold angle through one wall surface array and the propagation amount of the fold angle through the other wall surface array are equal to each other with respect to the generating surface array being continuous flat surfaces g1, g2, . . . , and gn (step SC-2).

Herein, when the fold angles between the adjacent surfaces of the shared surface array (generating surface array) are set to cp1, cp2, . . . , and cpn-1, from above equation (1), the fold angles between the adjacent surfaces of the wall surface array are set to $-\varphi 1$, $-\varphi 2$, . . . , and $-\varphi n-1$. On the other hand, the fold angles of the fold lines between the wall surface array and the shared surface array are all equal. If this is set arbitrarily as p, a ratio of tangents of the half angles of the fold lines in a column direction and a row direction $ki=\tan \rho/\tan(\varphi i/2)$ is determined. By deforming above equation (2), the following equation may be obtained from the relation of the internal angles.

[Equation 5]

By determining arbitrary initial parameters $\rho$ and $\alpha 1$, $\beta 1$ may be determined and the angle of the fold line starting from the first vertex may be determined. This intersects with the ridge line between g2 and g3, and $\alpha 2$ is determined. Also, $\beta 2$ is determined from equation (5). In this manner, the origami structure generation unit 102*a* may determine the internal angles of all the fold lines in a chain reaction. Meanwhile, the origami structure generation unit 102*a* also determines the wall surface structure by the similar process also for the wall surface array on the opposite side.

Returning to FIG. 18 again, on the basis of the generating surface and the two wall surface arrays generated by the origami structure generation unit 102*a*, the tubular structure forming unit 102*b* translates the wall surface array in the generatrix direction of the cylindrical surface to duplicate, and connects the upper surface with a surface array parallel to the generating surface, thereby generating the tubular structure of one surface (step SC-3). Meanwhile, the origami structure generation unit 102*a* obtains the tubular structures on both sides by applying the equivalent operation also to the opposite side.

Then, the structure output unit 102*c* outputs the deployment diagram data of the foldable structure formed by the tubular structure forming unit 102*b* to the output unit 114 such as a printing machine, a 3D printer, and a laser cutter, thereby manufacturing the foldable structure (step SC-4).

The above is an example of the process of manufacturing the foldable structure satisfying the conformity condition 3.

Experimental Data on Structural Stiffness

Figure 19A:
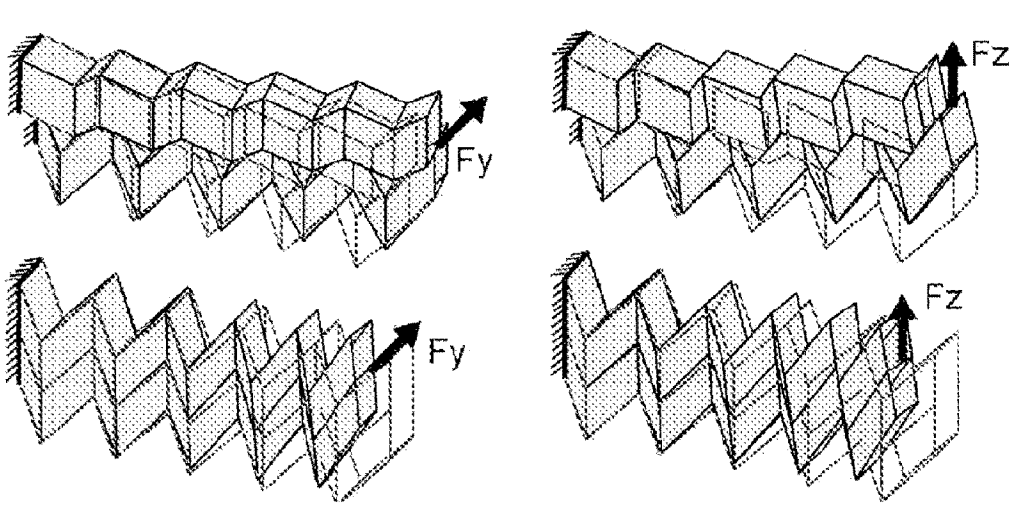
FIGS. 19A and 19B are views respectively illustrating a cantilever structure of a zipper- coupled structure (zipper) and an aligned-coupled structure (aligned)
Figure 19B:
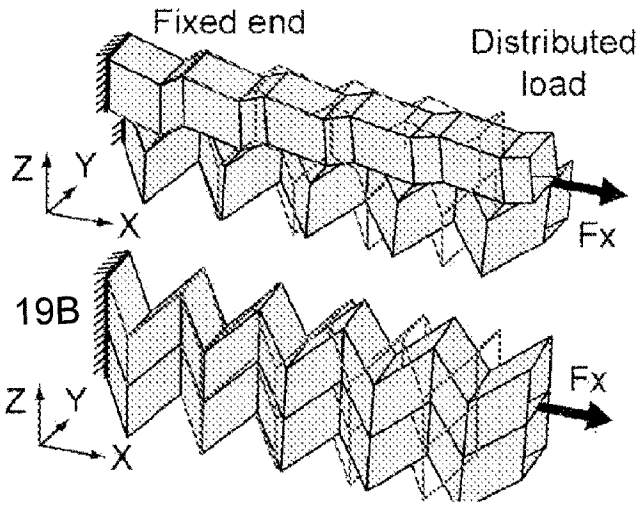

Subsequently, it is described with reference to a simulation result using the finite element method that the zipper-coupled tubular structure according to this embodiment is excellent in structural stiffness. Herein, FIGS. 19A and 19B are views respectively illustrating a cantilever structure of (a) zipper-coupled structure (zipper), and (b) an aligned-coupled structure (aligned). For the finite element method simulation, ABAQUS Finite Element Analysis was used.

As illustrated in FIGS. 19A and 19B, a simulation experiment was conducted when extension is 70% of the longest extension. Herein, height and width of a parallelogram surface forming the tubular structure were set to 1, the internal angle of the parallelogram was set to 55°, and thickness of the material was set to 0.01 which is one hundredth of the height. Also, the Young's modulus of the material was set to 1,000,000. Meanwhile, all the vertices on a left end were fixed, and a load of 1 was applied to a right end in an X direction (extension and contraction direction), a Y direction, and a Z direction (vertical direction) as indicated by arrows. In the drawing, a shape before deformation and a highlighted shape after deformation are overlapped. Meanwhile, the units of length and load may be arbitrary set, for example, the length, the force, and the Young's modulus may be represented in cm, N, and N/cm^2, respectively. Regardless of unit systems to be used, a relative relationship between the zipper-coupling and the aligned-coupling is maintained.

Figure 20:
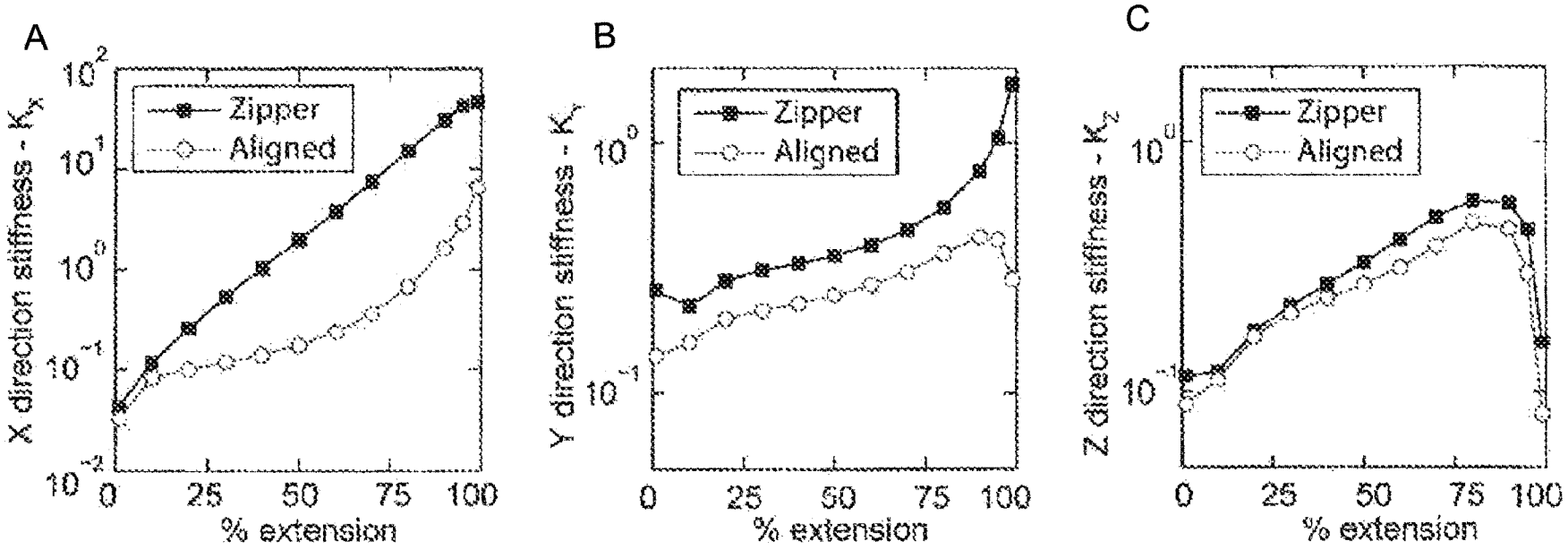
FIGS. 20A-20C are graphs illustrating change in stiffness with respect to an extension and contraction ratio with the horizontal axis representing the extension and contraction ratio of the tube and the vertical axis representing the stiffness.

Herein, FIGS. 20A-20C are graphs illustrating change in stiffness with respect to an extension and contraction ratio with the horizontal axis representing the extension and contraction ratio of the tube and the vertical axis representing the stiffness. From the left of the drawing, the stiffness in the X direction (FIG. 20A), the Y direction (FIG. 20B), and the Z direction (FIG. 20C) are represented, respectively. As the stiffness, a value obtained by dividing the magnitude of the force by an absolute value of displacement at the end is used. As illustrated in FIGS. 20A-20C, the stiffness of the zipper-coupled structure (Zipper) especially in the X direction was confirmed to be high in a wide range of an extension and contraction process.

Figure 21A:
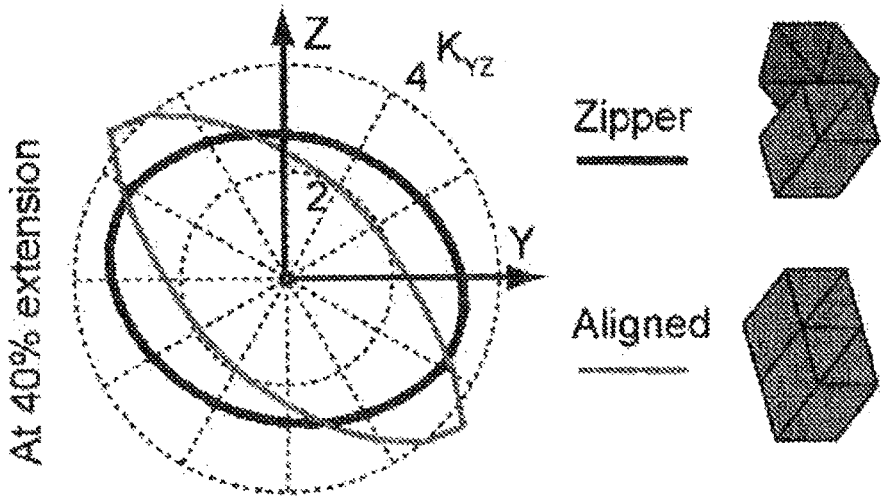
FIGS. 21A-21C are graphs respectively illustrating the stiffness with respect to a direction of force on a YZ plane at 40%, 70%, and 95% extension of the tube, respectively.
Figure 21B:
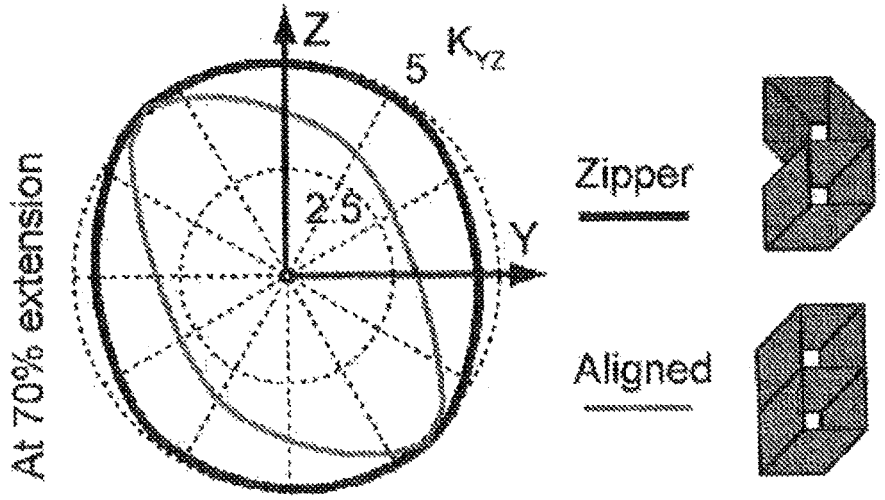
Figure 21C:
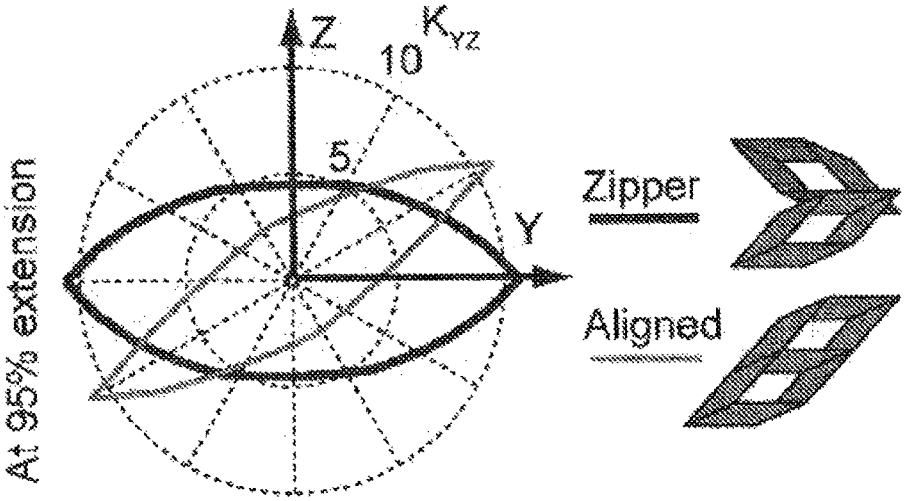

Herein, FIGS. 21A-21C are graphs respectively illustrating the stiffness with respect to a direction of force on a YZ plane at 40%, 70%, and 95% extension of the tube, respectively. In any of the extended states, it was confirmed that the zipper-coupled structure had little directional dependency and the stiffness of a weak shaft (minimum stiffness) was the maximum.

Other Structure Design

The embodiment of the foldable structure described above is merely an example, and various embodiments of structures other than the above may also be obtained. Herein, FIGS. 22A-22C are views respectively illustrating a unit structure and a tubular structure for obtaining an embodiment of another structure.

Figure 22A:
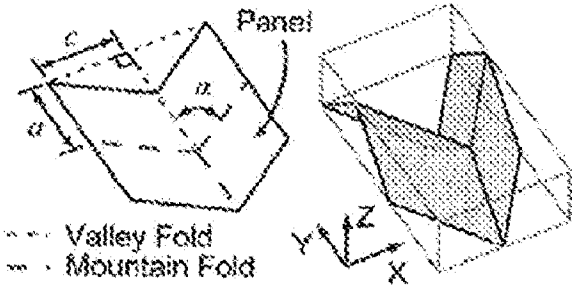
FIGS. 22A-22C are views illustrating a unit structure and a tubular structure for obtaining an embodiment of another structure.
Figure 22B:
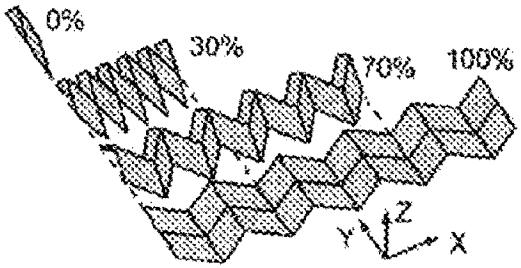
Figure 22C:
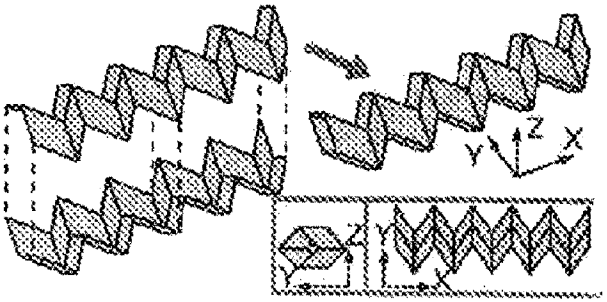

As illustrated in FIGS. 22A-22C, the basic tubular structure is formed of the unit structure illustrated in FIG. 22A. As illustrated in the drawing, the unit structure is formed of three variables a, a, and c. By repeating this N times, the tubular structure is formed. If c is the same, it is possible to couple with a tubular structure with different a and a. Meanwhile, when the surface is a rigid body, it is a mechanism with one degree of freedom, and a ratio of a length to a length in a flat state is expressed in % as a deployment rate.

Figure 23A:
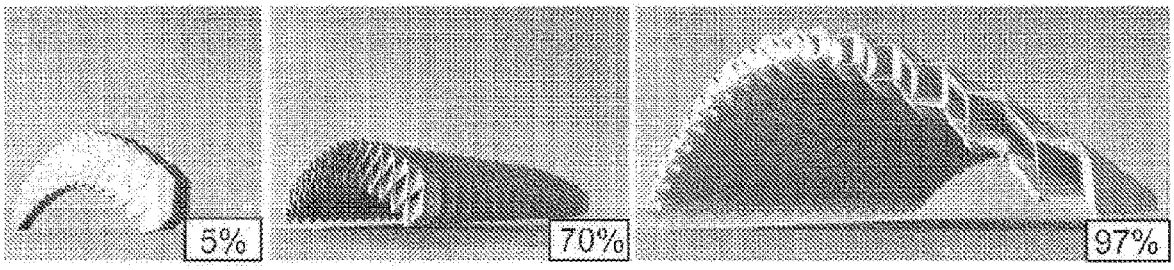
FIGS. 23A-23C are views respectively illustrating a transition from the folded state to the deployed state of the foldable structures A, B, and C.
Figure 23B:
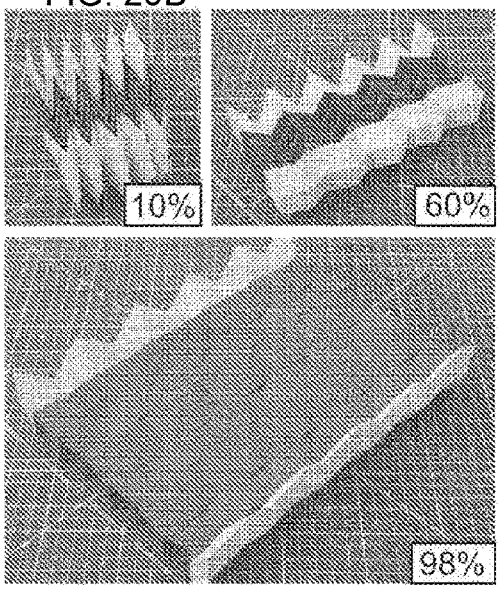
Figure 23C:
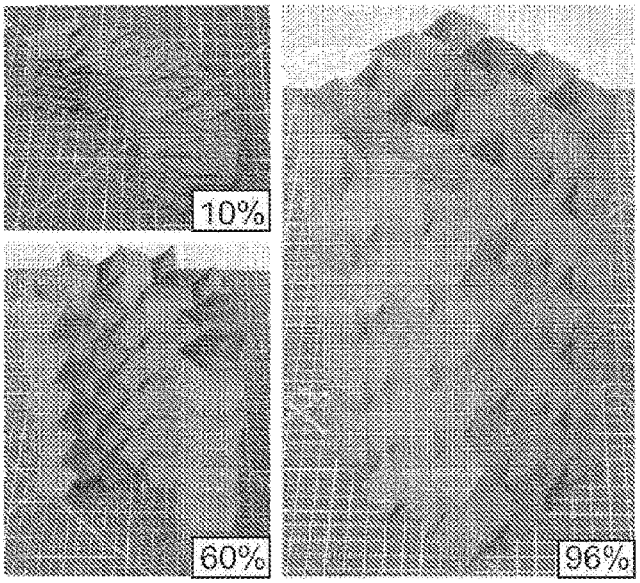

Herein, FIGS. 23A-23C are views respectively illustrating transition from the folded state to the deployed state of the foldable structures A, B, and C. Approximate deployment rate is represented in %.

FIG. 23A assumes the use for a building roof, and it is possible to realize high out-of-plane stiffness and deformability. Meanwhile, 32 tubular structures are alternately arranged. Meanwhile, a change from 58° to 84° and a=c=0.3 [m] and N=16. They are changed one by one such that an entire cross-section follows along a plane curve. At the time of 97% deployment, an area of 8.1 [m]×9.3 [m] is covered with a rise of 2.6 [m]. At the time of 5% folding, it is folded to 5.1 [m]×0.5 [m]×1.3 [m].

FIG. 23B assumes the use as a bridge using different tubular structures; this is bidirectionally flat-foldable, and has high out-of-plane stiffness. $\alpha$=55° in the tubular structures on both sides and $\alpha$=85°, a=c=25 [mm], and N=5 in six tubular structures at an intermediate part.

The folding structure illustrated in FIG. 23C has a structure in which ends may be mated to be fixed in a 96.3% deployment state from a state folded flat in one direction.

After performing zipper-coupling operation of facing surfaces continuously three times, a next tube is zipper-coupled to the next surface. By performing this operation four times, the structure is such that four side surfaces are closed continuously when being deployed. That is, in a case of transition from the folded state to the deployed state, the tubular structures which are not adjacent to each other so far may be adjacent to be coupled to each other, so that retransition to the folded state may be inhibited. This is formed of 12 tubular structures of $\alpha$=75°, a=c=25 [mm], and N=5.

Figure 24A:
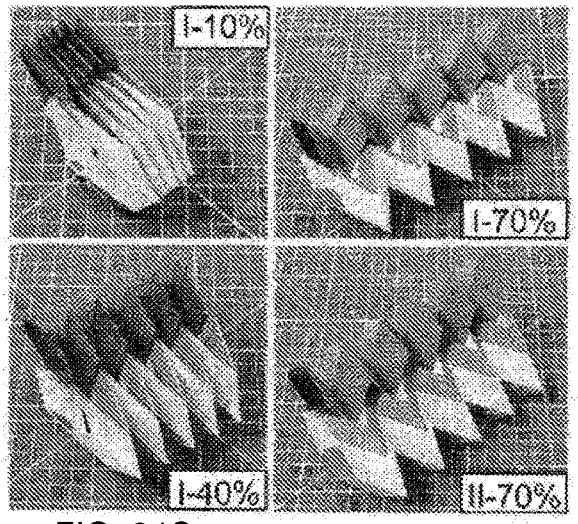
FIGS. 24A-24C are views respectively illustrating a transition from the folded state to the deployed state of the foldable structures A, B, and C.
Figure 24B:
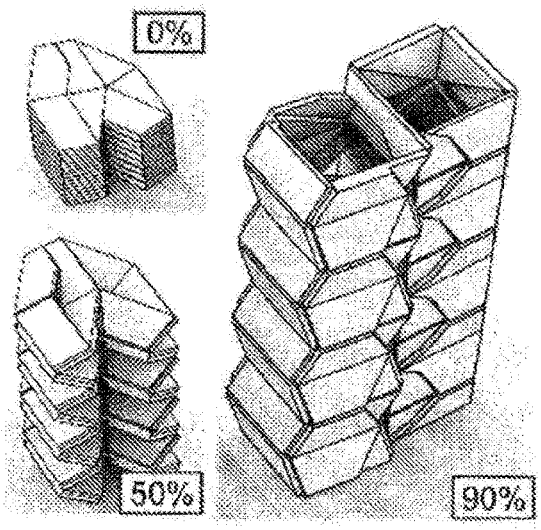
Figure 24C:
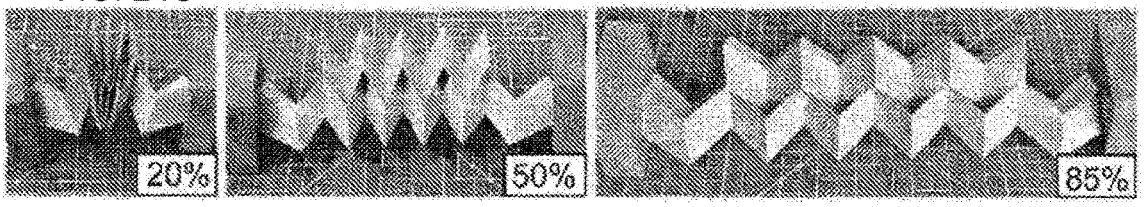

Herein, FIGS. 24A-24C are views respectively illustrating transition from the folded state to the deployed state of the foldable structures A, B, and C. FIG. 24A is a view illustrating the zipper-coupling to a structure having a polygonal cross-section. Also, FIG. 24B is a view illustrating an example of the zipper-coupling realized by a panel having a thickness. a=80 mm, c=40 mm, a=75°, and N=4. There are two kinds of thicknesses: t=5 mm and t=10 mm.

Also, FIG. 24C assumes the use as an actuator system of the zipper-coupled tubes of different lengths. The end is fixed so as to put liquid inside the long tubular structure. However, an influence of fixing the end disappears due to a non-uniform deformation mode at the end, so that an intermediate part is independently foldable. On the other hand, the entire intermediate part exhibits a uniform deformation mode with one degree of freedom with zipper-coupling.

Figure 25:
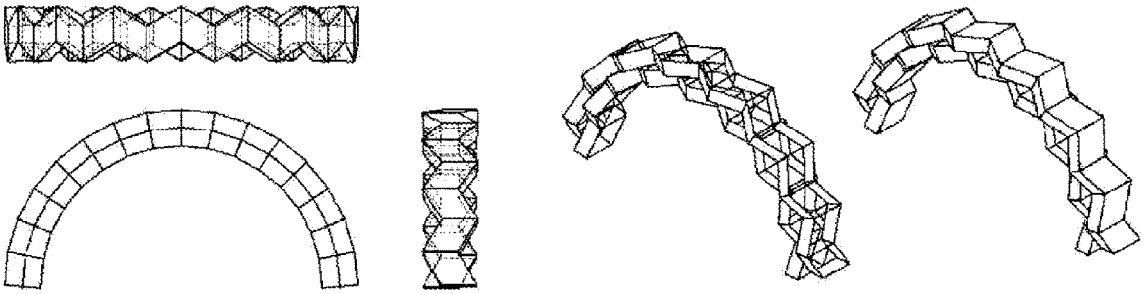
FIG. 25 is a view illustrating an example of an arch-shaped structure using mirror reversal of a wall surface.
Figure 26:
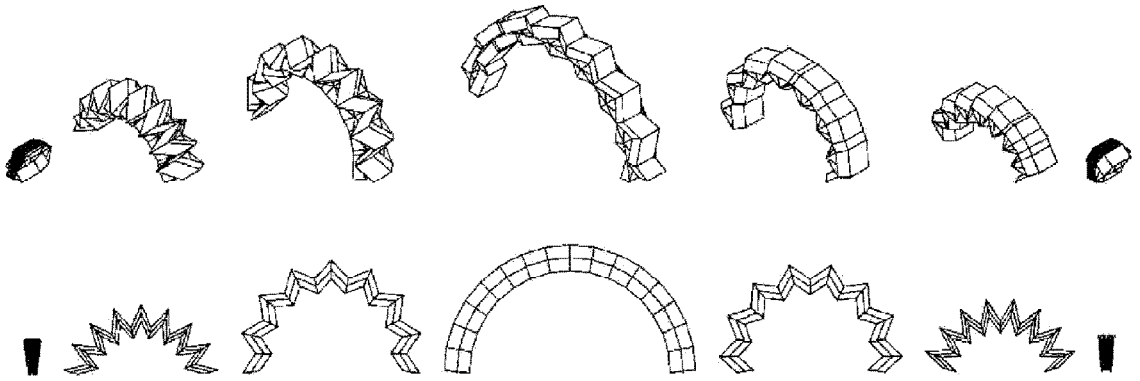
FIG. 26 is a view illustrating a folding process of the arch-shaped structure using the mirror reversal of the wall surface in FIG. 25.

Herein, FIG. 25 is a view illustrating an example of an arch-shaped structure using mirror reversal of the wall surface, and FIG. 26 is a view illustrating a folding process of the arch-shaped structure using the mirror reversal of the wall surface of FIG. 25. Meanwhile, this arch-shaped structure is flat-foldable (with flat-foldability).

Figure 27:
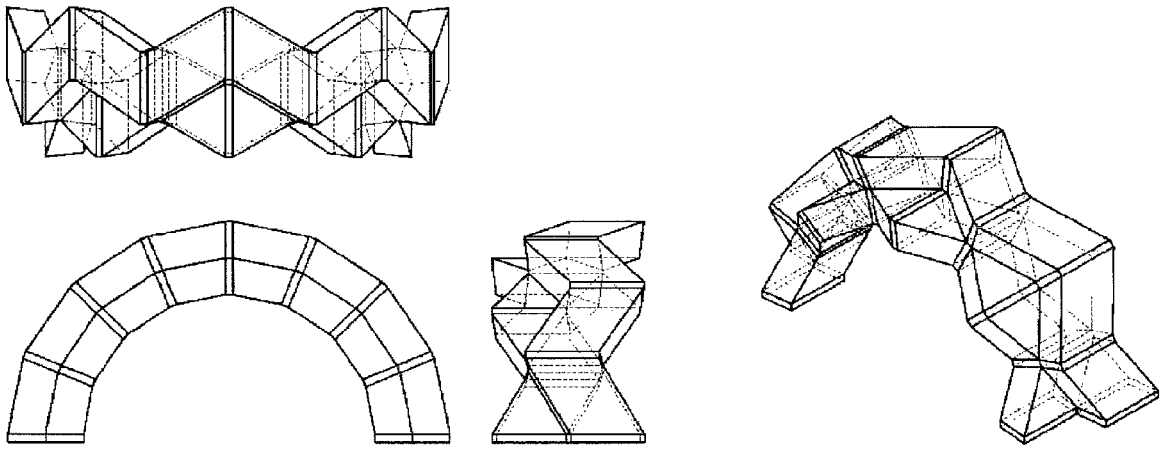
FIG. 27 is a view illustrating another example of the arch-shaped structure using mirror reversal of the wall surface.
Figure 28:
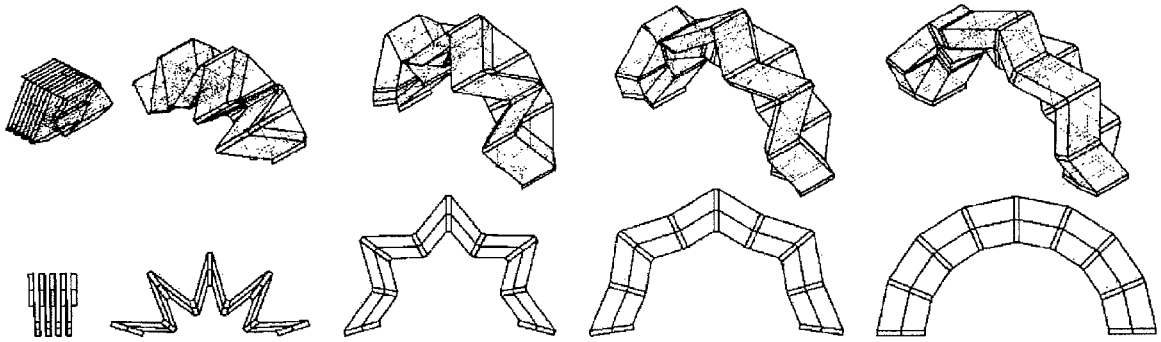
FIG. 28 is a view illustrating a folding process of the arch-shaped structure using the mirror reversal of the wall surface of FIG. 27.

Also, FIG. 27 is a view illustrating another example of the arch-shaped structure using mirror reversal of the wall surface, and FIG. 28 is a view illustrating a folding process of the arch-shaped structure using the mirror reversal of the wall surface of FIG. 27. As illustrated in the drawing, in a case of this example, the arch-shaped structure is folded with a width.

Figure 29:
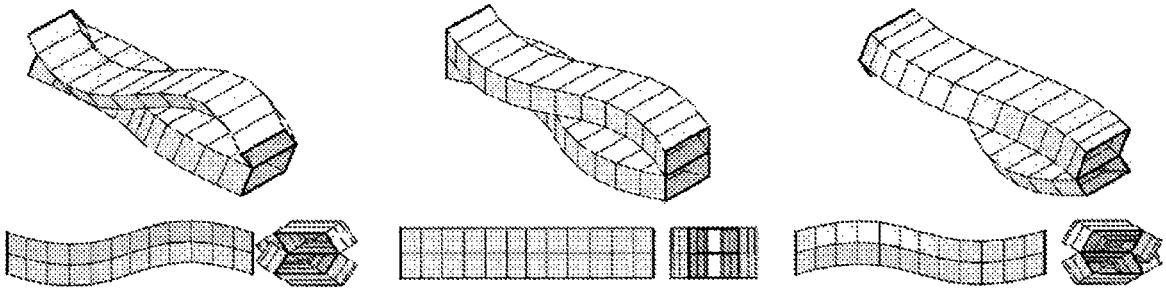
FIG. 29 is a view illustrating an example of a structure using the mirror reversal as a curved sandwich core.

Also, FIG. 29 is a view illustrating an example of a structure using the mirror reversal as a curved sandwich core. As illustrated in the drawing, in a case of this example, although this cannot be flat-folded and has no flat-foldability, this may be folded to be deformed (with foldability). Meanwhile, this curved sandwich core has a curved tubular structure in which the shared surface array and the wall surface arrays are infinitely subdivided and smoothed, so that seven surface arrays are formed of smooth curved surfaces, and it is possible to obtain a foldable structure in which each surface is bent to be deformed and deformed by being folded along the fold line between the surfaces. Also, by inserting this core structure into two flexible sheet materials, a curved sandwich structure capable of being bent to be deformed may be formed.

The description of this embodiment herein ends.

Another Embodiment

Although the embodiment of the present invention has been described so far, the present invention may be carried out in various embodiments other than the above-described embodiments within the scope of the technical idea recited in claims.

For example, although it is described that the manufacturing device 100 performs processing in a standalone form, the manufacturing device 100 may perform processing in response to a request from a client terminal (such as the external device 200) and return a processing result to the client terminal.

Also, among all the processes described in the embodiments, it is possible to manually perform all or a part of the processes described to be performed automatically, or it is possible to automatically perform all or a part of the processes described to be manually performed by a well-known method.

In addition to this, a procedure, control means, specific names, information including registration data of each process and parameters such as retrieval conditions, screen examples, and database configuration illustrated in the above documents and drawings may be arbitrarily changed unless otherwise noted.

Regarding the manufacturing device 100, the illustrated components are functionally conceptual, and it is not necessarily required that they be physically structured as illustrated.

For example, all or an arbitrary part of a processing function of each device of the manufacturing device 100, especially each processing function performed by the control unit 102 may be realized by a central processing unit (CPU) and a program interpreted and executed by the CPU, or may be realized as hardware by wired logic. Meanwhile, the program is recorded in a non-transitory computer-readable recording medium including a programmed instruction for allowing the computer to execute the method according to the present invention to be described later, and is mechanically read by the manufacturing device 100 as needed. That is, in the storage unit 106 such as the ROM or the hard disk drive (HDD), a computer program for giving instructions to the CPU in cooperation with the operating system (OS) and performing various processes is recorded. This computer program is executed by being loaded into the RAM, and cooperates with the CPU to form a control unit.

Also, this computer program may be stored in an application program server connected to the manufacturing device 100 via an arbitrary network 300, and it is also possible to download all or a part thereof as needed.

Also, the program according to the present invention may be stored in a computer-readable recording medium, or may be formed as a program product. Herein, the "recording medium" includes an arbitrary "portable physical medium" such as a memory card, a USB memory, an SD card, a flexible disk, a magneto-optical disk, a ROM, an EPROM, an EEPROM, a CD-ROM, an MO, a DVD, and a Blu-ray (registered trademark) Disc.

Also, the "program" is a data processing method described in an arbitrary language or description method, regardless of the format of source code, binary code and the like. Meanwhile, the "program" is not necessarily limited to a single program, but this includes that configured in a distributed manner as a plurality of modules or libraries, or that achieving its function in cooperation with a separate program represented by an operating system (OS). Meanwhile, well-known configurations and procedures may be used for specific configurations for reading the recording medium, reading procedures, installation procedures after reading or the like in the respective devices described in the embodiments. The present invention may be configured as a program product in which a program is recorded in a non-transitory computer-readable recording medium.

Various databases and the like (geometric parameter storage unit 106*a* and the like) stored in the storage unit 106 are memory devices such as RAM and ROM, fixed disk devices such as hard disks, and storage means such as flexible disks and optical disks, and store various programs, tables, databases, files for web pages and the like used for various processes and website presentation.

Also, the manufacturing device 100 and the external device 200 may be configured as an information processing device such as known personal computer, workstation and the like, and may be configured by connecting an arbitrary peripheral device to the information processing device. Also, the manufacturing device 100 and the external device 200 may be realized by mounting software (including programs, data and the like) for realizing the method of the present invention on the information processing device.

Furthermore, specific modes of device distribution/integration are not limited to those illustrated, and all or a part thereof may be configured so as to be functionally or physically distributed or integrated in an arbitrary unit in accordance with various additions or the like, or in accordance with a functional load. That is, the above-described embodiments may be arbitrarily combined to be carried out or the embodiment may be selectively carried out.

As described above, the present invention may provide a foldable structure to which stiffness is imparted so as to inhibit non-uniform extension and contraction even when each surface is formed of a flexible material, a manufacturing method and a manufacturing device of the foldable structure, and a non-transitory computer-readable computer medium storing a program. For example, such foldable structure may be used for doors without hinges, roofs, and buildings such as temporary housings. It is also useful as furniture such as chairs, outdoor equipment and the like which may be compactly transported and deployed at a necessary place. In addition, since this can transmit force while being flexible, this may also be used as a material for soft robotics engineering. In addition, this is also useful as an actuator, a morphing blade whose shape changes without using a hinge, an extension mast, a medical material such as a stent and the like.

What is claimed is:

1. A foldable structure comprising:

at least two tubular structures, wherein the two tubular structures include a shared surface array which is continuous shared surfaces shared by the two tubular structures, and a twisting characteristic in the shared surface array of one tubular structure is in a direction opposite to the direction of the twisting characteristic in the shared surface array of the other tubular structure.

2. The foldable structure according to claim 1, wherein the tubular structures are such that, in a case of transition between a deployed state and a folded state, a propagation amount of a fold angle around the shared surface through one tubular structure is equal to the propagation amount through the other tubular structure.

3. The foldable structure according to any one of claim 1, wherein in a case of transition from a folded state to a deployed state, the tubular structures which are not adjacent to each other so far are adjacent and may be coupled, so that retransition to the folded state may be inhibited.

4. The foldable structure according to any one of claim 1, wherein a surface of the shared surface array is a conceptual surface formed of a plurality of fold lines.

5. The foldable structure according to any one of claim 1, wherein the foldable structure is a folding structure or a flat-foldable structure.

6. The foldable structure according to claim 2, wherein the shared surface array is an arbitrary single curved surface, and an internal angle at a tetravalent vertex formed of the shared surface array and the wall surface array of the tubular structure including an adjacent wall surface array is such that the sum of opposite angles is 180° or the opposite angles are equal to each other, and a propagation amount of the fold angle through one wall surface array is equal to the propagation amount of the fold angle through the other wall surface array.

7. The foldable structure according to claim 2, wherein the shared surface array is a cylindrical surface in which the shared surfaces are connected by parallel ridge lines, and where a wall surface array of one tubular structure is such that the extension of the wall surface to the other side so as to penetrate the cylindrical surface is mirror symmetric with the wall surface array of the other tubular structure with respect to a plane orthogonal to the cylindrical surface.

8. The foldable structure according to any one of claim 7, wherein in a case of transition from a folded state to a deployed state, the tubular structures which are not adjacent to each other so far are adjacent and may be coupled, so that retransition to the folded state may be inhibited.

9. The foldable structure according to claim 2, wherein the two tubular structures are Miura-ori tubular structures, and one tubular structure and the other tubular structure are zipper-coupled such that fold line portions intermesh with each other in the shared surface array.

10. The foldable structure according to any one of claim 6, wherein in a case of transition from a folded state to a deployed state, the tubular structures which are not adjacent to each other so far are adjacent and may be coupled, so that retransition to the folded state may be inhibited.

11. The foldable structure according to any one of claim 2, wherein in a case of transition from a folded state to a deployed state, the tubular structures which are not adjacent to each other so far are adjacent and may be coupled, so that retransition to the folded state may be inhibited.

12. The foldable structure according to any one of claim 2, wherein a surface of the shared surface array is a conceptual surface formed of a plurality of fold lines.

13. The foldable structure according to any one of claim 2, wherein the foldable structure is a folding structure or a flat-foldable structure.

14. The foldable structure according to claim 1, wherein the two tubular structures are Miura-ori tubular structures, and one tubular structure and the other tubular structure are zipper-coupled such that fold line portions intermesh with each other in the shared surface array.

15. The foldable structure according to any one of claim 14, wherein in a case of transition from a folded state to a deployed state, the tubular structures which are not adjacent to each other so far are adjacent and may be coupled, so that retransition to the folded state may be inhibited.

* * * * *